US009038214B2

(12) United States Patent
Hardin

(10) Patent No.: US 9,038,214 B2
(45) Date of Patent: May 26, 2015

(54) HIPPA PRIVACY INFECTIOUS CONTROL SCREEN FOR GURNEYS AND OTHER MOBILE TRANSPORTABLE BEDS FOR EMERGENCY AND OTHER INTER AND INTRA HEALTHCARE FACILITY TRANSFERS

(76) Inventor: Leslie Malott Hardin, Yorktown, IN (US)

( * ) Notice: Subject to any disclaimer, the term of this patent is extended or adjusted under 35 U.S.C. 154(b) by 1151 days.

(21) Appl. No.: 12/928,193

(22) Filed: Dec. 6, 2010

(65) Prior Publication Data

US 2011/0133938 A1 Jun. 9, 2011

Related U.S. Application Data

(60) Provisional application No. 61/283,646, filed on Dec. 7, 2009.

(51) Int. Cl.
*A61G 7/05* (2006.01)
*A47C 21/00* (2006.01)

(52) U.S. Cl.
CPC ..... *A61G 7/0526* (2013.01); *A47C 21/00* (2013.01); *A61G 7/0507* (2013.01)

(58) Field of Classification Search
CPC ..... A61G 7/0507; A61G 2007/0509; A61G 2007/0516; A61G 2007/0519; A47C 21/08; A47C 21/00
USPC ..... 5/512, 658, 663, 503.1–506.1, 424–430
See application file for complete search history.

(56) References Cited

U.S. PATENT DOCUMENTS 1,021,930 A * 4/1912 Jackson ..... 135/121
1,344,588 A * 6/1920 Kozik ..... 5/512
3,670,750 A * 6/1972 Johnston ..... 135/148
5,640,726 A * 6/1997 Fichner-Rathus ..... 5/426
5,761,756 A * 6/1998 Nowak et al. ..... 5/426
6,216,291 B1 * 4/2001 Eads et al. ..... 5/424

(Continued)

OTHER PUBLICATIONS iroomdividers.com, website showing prior art VP6 Mobile Room Divider; Versare Plastic Opaque Room;MP10 Ten Foot Wide Mobile Room Divider; FP6 Three Panel Room Divider.

(Continued)

*Primary Examiner* — Robert G Santos
(74) *Attorney, Agent, or Firm* — E. Victor Indiano; Indiano Law Group, LLC

(57) ABSTRACT

A movable privacy screen includes a plurality of privacy screen segments that are attachable to a bed or gurney. The plurality of screen segments include at least first and second screen segments. Each of the first and second screen segments include a first support pole, a second support pole and a coupler. The first support pole has a variable length to permit the first support pole to move between a collapsed configuration and an expanded configuration. The second support pole has a variable length to permit the second support pole to move between a collapsed configuration and an expanded configuration. The coupler movably couples the first and second support poles to the bed in a spaced relation to permit the first and second support poles to move between an upstanding use position and a lowered storage position. A fabric-like screen member is coupled to each of the first and second support poles. The fabric-like screen member is sized to extend between the first and second support poles, and is movable between a raised use position and a lowered storage position.

17 Claims, 19 Drawing Sheets

(56) References Cited

U.S. PATENT DOCUMENTS

| | | | | |
|---|---|---|---|---|
| 6,436,420 | B1 * | 8/2002 | Antelman | 424/404 |
| 6,487,735 | B1 * | 12/2002 | Jacques et al. | 5/424 |
| 6,694,547 | B1 * | 2/2004 | Vail | 5/424 |
| 6,990,697 | B1 * | 1/2006 | Clute | 5/426 |
| 7,028,353 | B2 * | 4/2006 | Waldman et al. | 5/430 |
| 7,237,285 | B2 * | 7/2007 | Brewin et al. | 5/426 |
| 8,458,831 | B2 * | 6/2013 | Flannery et al. | 5/426 |
| 8,555,436 | B2 * | 10/2013 | Flannery et al. | 5/429 |
| 8,726,433 | B1 * | 5/2014 | Flannery et al. | 5/426 |
| 8,966,682 | B1 * | 3/2015 | Flannery et al. | 5/426 |
| 2004/0168251 | A1 * | 9/2004 | Waldman et al. | 5/426 |
| 2004/0250347 | A1 * | 12/2004 | Brewin et al. | 5/426 |
| 2005/0241648 | A1 | 11/2005 | Dobbs | |
| 2006/0037140 | A1 * | 2/2006 | Clute | 5/430 |
| 2006/0162075 | A1 * | 7/2006 | Waldman et al. | 5/426 |
| 2006/0252326 | A1 * | 11/2006 | Mishler | 442/123 |
| 2011/0133938 | A1 * | 6/2011 | Hardin | 340/573.4 |
| 2012/0084915 | A1 * | 4/2012 | Flannery et al. | 5/426 |
| 2012/0084916 | A1 * | 4/2012 | Flannery et al. | 5/426 |

OTHER PUBLICATIONS www.portablepartitions.com; Dec. 3, 2010; website showing prior art portable partitions, room dividers, portable walls, privacy screen, etc.

www.eclmedical.com/mri.htm: East Coast Laser & Medical; website showing prior art portable privacy screen.

* cited by examiner

HIPPA PRIVACY INFECTIOUS CONTROL SCREEN FOR GURNEYS AND OTHER MOBILE TRANSPORTABLE BEDS FOR EMERGENCY AND OTHER INTER AND INTRA HEALTHCARE FACILITY TRANSFERS

I. PRIORITY STATEMENT

This application claims benefit and/or priority to Leslie M. Malott, U.S. provisional patent application No. 61/283,646 that was filed on 7 Dec. 2009, and that is incorporated herein by reference in its entirety.

II. TECHNICAL FIELD OF THE INVENTION

The present invention relates to medical equipment, and more particularly, to a privacy screen or curtain that can be coupled to a hospital bed or gurney, to provide privacy for a patient while also helping to reduce the spread of infection between patients in a hospital.

III. BACKGROUND OF THE INVENTION

A visit to a hospital by a patient often involves the placement of the patient in a bed or gurney, and the treatment of the patient while in the bed or gurney. As used in this application, the term "bed" will be used to collectively designate both beds and gurneys. Hospital beds and gurneys are similar items, with a hospital bed typically being a larger structure that is usually stationarily positioned within a room, even though the bed may have wheels to enable the bed to be moved within the hospital.

In contrast, a gurney is a more temporary type of bed that is intended to hold a patient temporarily, with the expectation that the patient will later be transported in the gurney to a hospital room where the patient will be placed in a hospital bed. Being smaller, lighter and less complex than a bed, a gurney is better suited for transportation between various areas in a hospital than a bed.

While in a hospital, the patient is often treated while in his bed. Such treatments usually involve the examination of the patient, drawing blood from the patient, and the like. Additionally, treatment procedures are performed on patients such as performing an EKG, suturing a patient, performing procedures on the patient (e.g. colonoscopy) and taking blood pressure.

Many of these treatments require the patient to partially or fully disrobe. For example, in order to perform an EKG on a patient, the patient's shirt must be removed (including a bra if performed on a woman). Various EKG leads are attached at various positions on to the patient's chest, and are hooked up to a machine. Such disrobing is preferably done in a private setting so that others can not view the patient's exposed body parts.

Normally, maintaining privacy is not a major issue for a patient who is in a patient room in the hospital, since most patient rooms are enclosed, and have doors that can be closed to keep prying eyes from viewing what is occurring inside the room. However, the privacy afforded by a hospital room is missing in certain circumstances. For example privacy is often compromised in emergency rooms within hospitals. Often, patients in hospital emergency rooms do not have any "privacy" guard around them, to prevent others from viewing the patient during the time that the patient is laying in his bed, or more importantly, when a procedure is occurring.

As used in this application, the term "privacy guard" will be used generically to denote a barrier that is placeable around a patient to ensure both privacy, and some degree of infection control. One type of privacy guard is the walls and doors that one finds in a hospital room. Other privacy guards include room divider curtains.

Many emergency and outpatient areas within hospitals do contain one or more treatment rooms that provide walls and doors as privacy barriers. However, many emergency rooms also have ward-like areas where a plurality of beds may be contained within a single room. Many of these treatment areas are designed for multiple patients, and include movable privacy guards. Movable privacy guards in a ward-like setting typically comprise curtains that are hung from a track attached to the ceiling. The track includes a channel for receiving curtain couplers, that couple the curtain to the track. These couplers often include slugs or track runners, that can move along a track channel, so that the curtain can be moved between an open position and a closed position.

Most such tracks are generally U-shaped, and include a first leg and a second leg that extend generally parallel to the first and second sides of the bed. A third leg connects the first and second legs, and extends generally parallel to the end surface (foot) of the bed. The area enclosed by the tracks should be about three times the area presented by the bed surface, to provide an area between the interior surface of the curtain and the side of the bed in which treating personnel may stand while performing treatments on the patient.

In use, the curtain is moved from an open position, where it is gathered usually at one end of the track, to a closed position where the curtain extends all the way around the U-shaped track to enclose the bed. The drawing of the fabric curtain around a patient being treated rarely provides a good sound barrier, to protect "noise privacy". However, the use of a fabric curtain does do a good job of providing visual privacy for the patient.

In addition to the privacy provided, the curtain also provides a measure of infection control. During treatment of a patient, it is not unusual for body fluids to become volatilized and sprays created. For example, a patient's sneeze can release an airborne spray containing a plurality of germs into the atmosphere. Additionally, a patient that is bleeding, sweating or moving, can discharge airborne pathogens. Because of the proximity of patients in such a ward-like setting, and the number of people in the ward, these airborne pathogens have a significant possibility of infecting nearby patients, visitors and hospital personnel.

It has been long appreciated that hospitals have infection vector laden environments. These infection vectors include bacterial and viral vectors. Certain infection vectors such as MRSA (methicillin resistant staphylococcus aureus) are especially troublesome because of their resistance to treatment with conventional antibiotics.

An airborne virus that is transferable between patients is tuberculosis (TB). Although it was previously thought that TB was functionally eradicated, it has made a resurgence in recent years. Other current pathogens of concern include the H1N1 virus, influenza viruses, and other airborne communicable disease vectors such as Vancomycin-resistant bacteria. As such, placing a curtain or other barrier to surround an infected patient serves as an infection barrier, that keeps such airborne pathogens contained within the area enclosed by the curtain.

One difficulty with the management of patients within a hospital setting, and especially in an emergency room setting, is that the number of resident patients is likely to fluctuate significantly. At certain times, an oversupply of available emergency rooms may exist. At other times, an emergency room can become highly crowded and devoid of available beds. In many emergency rooms, peak population events occur where the number of patients seeking treatment and being treated in the emergency room will exceed the number of patient treatment rooms, and "ward-like" beds.

During such times, patients needing treatment are often placed on gurneys in an ER hallway, or in an open treatment area that contains no type of privacy guard. Patients are often in hallways and held in something of a waiting pattern until a room opens up.

Because of the number of people that may be contained within an emergency room at a particular time, and because of a patient's need for treatment, the medical team will often begin to perform a treatment on a patient while the patient is on the gurney in a hall or other open area.

Another issue of concern to a patient is confined to a gurney in an open area is how to handle the patient's need to relieve him/herself. If the patient can not ambulate to a restroom, the patient may be forced to disrobe, and be placed upon a bed pan and relieve himself/herself in a semi-public area.

Currently, no satisfactory method or device exists for providing a privacy guard for such patients. Often, the situation is handled by moving a patient from an open area into a room, so that the person can go to the bathroom or be treated while in the room. Concurrently, the person in the room is moved outside into the hallway while the person in the room undergoes the treatment or procedure. Such swapping of patients in and out of rooms is time consuming, results in procedures being delayed, and has the potential to result in clinical mistakes.

Another way of handling privacy issues is for a nurse or doctor to stand close to the patient while holding up a bed sheet to serve as a privacy guard while the patient is either relieving himself or having a treatment performed. This technique is highly labor intensive, and provides an imperfect and possibly unsuitable privacy guard for the patient.

Therefore, one object of the present invention is to provide a privacy guard that can be coupled to a gurney to provide a modicum of privacy for a patient who is placed on a gurney or hospital bed in an open area, where no permanent privacy guard (e.g. curtains on tracks, or room walls) exist currently.

In addition to the emergency room situations described above, another area where privacy screens are helpful (but do not currently exist) is in transportation situations. The need for a privacy guard during transportation situations springs as much from infection control concerns as from privacy concerns.

Patients are often transferred between various areas in a healthcare facility. For example, in-patients who are residing in rooms and in hospital beds will often be transported from one room to another room in the hospital, or to a different department of the hospital, such as the radiology department.

During transportation of the patient, a patient's privacy can usually be guarded or preserved reasonably well by placing a blanket or a sheet over the patient's body. However, placing a sheet or blanket over the patient will not guard against the spread of infectious agents. For example, a patient who is in a room may need to be transported through the hospital's common areas to the CAT scan machine room. If the particular patient has been diagnosed as having a MRSA infection or a TB infection, one would wish to guard against the infection being spread to other areas and surfaces in the hospital, and other patients.

In order to prevent spreading the infection, it would be helpful to have a privacy guard, such as a screen, around the patient. Through a privacy screen, any sneezes, wheezes or airborne launched microbes could be prevented from escaping the barrier provided by the hospital screen.

Another area where gurneys are used to transport patients are ambulances. During any given day, a particular ambulance may be used to transport several different patients. Often, there is no time to sterilize the ambulance between runs. Since many bacteria and viruses can live outside the body for hours, long-lasting viruses and bacterias deposited in an ambulance can become resident in the ambulance, thus potentially infecting the ambulance crew along with subsequent patients within the ambulance.

In order to prevent the transfer of such infections, it would be helpful to have a privacy screen within the ambulance, to serve as a barrier for preventing the transfer of the infections from the patient to permanent surfaces in the ambulance, such as the walls, cabinets, and the like. Additionally, patient treatment often begins in the ambulance. During the course of this treatment, a patient may be partially or fully disrobed in order to perform whatever procedures are necessary. As such, it would be helpful to have a privacy guard to protect the privacy of the patient (and control infection) as the patient is moved from the ambulance and through the emergency room to the area within the emergency room where the patient is ultimately deposited or placed.

In addition to the trip between the ambulance and the emergency room, it would also be helpful to provide a privacy guard for the patient during the trip from the facility room to the ambulance. For example, nursing home patients being taken to a hospital are often loaded onto a gurney in their nursing home room, and then are wheeled through the nursing home and through an outside door of the nursing home to the ambulance parked outside. By placing a privacy screen on the ambulance gurney for the patient's trip through the nursing home, one can protect not only the privacy of the patient, but also help to protect visitors and others in the nursing home from possible patient-borne infections.

The reverse also applies. There are many circumstances where it is desirable to protect the patient from the infections of non-patients. By placing a privacy screen around the patient, one can reduce the likelihood that such airborne pathogens will infect the gurney-resident patient.

Currently, portable screens are used as privacy barriers in emergency rooms. These screens are not very well loved or used, because they are cumbersome, not readily available, do not provide great privacy features, do not inhibit infectious disease and are often in a state of disrepair. Examples of such screens can be found at www.iroomdividers.com, and include the Versaware plastic opaque room divider, the FP6 room divider, the VP6 portable room divider and others.

Such portable screens typically comprise a metal of frame on which a curtain is supported. A plurality of legs hold the metal frame off the ground, and support the frame. These frames are generally not easily transportable, and usually are not designed to be transported with the gurney. As such, although one can use the privacy screen around a bed while the bed is in a fixed position, the screen cannot be moved with the bed as it is transported in the hospital. As such, these screens do not provide a satisfactory solution of the problems discussed above.

It is therefore one object of the present invention to provide a privacy screen that is well adapted for use on hospital beds and gurneys.

IV. SUMMARY OF THE INVENTION

In accordance with the present invention, a movable privacy screen is provided for attachment to a bed. The privacy screen comprises a plurality of privacy screen segments attachable to the bed or gurney. The plurality of screen segments include at least first and second screen segments. Each of the first and second screen segments includes a first support pole, a second support pole and a coupler. The first support pole has a variable length to permit the first support pole to move between a collapsed configuration and an expanded configuration. The second support pole has a variable length to permit the second support pole to move between a collapsed configuration and an expanded configuration. The coupler movably couples the first and second support poles to the bed in a spaced relation to permit the first and second support poles to move between an upstanding use position and a lowered storage position. A fabric-like screen member is coupled to each of the first and second support poles. The fabric-like screen member is sized to extend between the first and second support poles, and is movable between a raised use position and a lowered storage position.

Preferably, the first and second support poles comprise first and second multi-segment telescoping support poles, with the first and second support poles each including a selectively actuable gripper for permitting the poles to be fixedly positioned in the expanded configuration.

Preferably, the grippers comprise detent devices that are provided for each section of the telescoping pole for fixedly positioning a first section of the support pole to a second section of the support pole, to maintain the support pole in a particular desired orientation, such as in an extended or collapsed orientation. This can be accomplished with spring loaded detent means in one segment that is selectively received by an aperture in a second segment. Additionally, various mechanisms can be used A first screen to pole fixed coupler is also provided for fixedly coupling the screen to the first pole, and a second screen to pole fixed coupler is provided for fixedly coupling the screen to the second pole. Movement of the first and second telescoping support poles between the collapsed configuration and the expanded configuration causes the screen member to move between the lowered position and the raised position.

Also in accordance with the present invention, a storage case is provided for attachment to a bed having a first end, a second end and a support frame having an upper and a lower surface. The storage case comprises a relatively rigid case portion having an upper surface fixedly coupled to the bed and disposed adjacent to the lower surface of the mattress support frame. The relatively rigid case also includes at least one storage compartment having an opening and a lockable door for lockably closing the opening. The case also includes a relatively soft case portion that is coupled to the rigid case portion and includes a storage area having an opening and a closure member for selectively closing the opening.

Preferably, at least one of the storage compartments of the relatively rigid case portion includes a plurality of end opening storage compartments, and the lockable door is hingedly coupled to the case for moving between an open position, and a closed position where the openings of the end openings storage compartment are closed. Additionally, the soft case portion preferably is expandable to provide a variable volume, and the closure member comprises a flap-type closure member, and a selectively releasable fastener for maintaining the flap in a closed position.

The screen should have a sufficient area, so that it can extend between a collapsed and expanded position. In a collapsed position, the area occupied by the screen is relatively smaller, and the expanded position of the area occupied by the screen is relatively greater. Also, one or more gatherers, such as straps can be provided to gather up the fabric screen, to hold the screen in a compressed position, or while in a storage position, to prevent the screen from touching the ground or getting caught under the wheels of the cart.

Most preferably, five or six screen portions are used, with the first and second screen portions being coupled to the first side of the gurney, a third and fourth screen portion being coupled to and arrayed along a second long side of the gurney. A fifth screen section is disposed generally perpendicular to the first, second, third and fourth screen sections, and is disposed to extend along the end surface of the gurney. Additionally, a sixth screen member can also be used that is disposed along the foot end of the gurney in a parallel plane with the fifth screen member.

These and other features of the present invention will become apparent to those skilled in the art upon a review of the detailed description and drawings below, that represent the best mode of practicing the invention that is perceived presently by the Applicant

V. BRIEF DESCRIPTION OF DRAWINGS

VI. DETAILED DESCRIPTION OF PREFERRED EMBODIMENT

Figure 1:
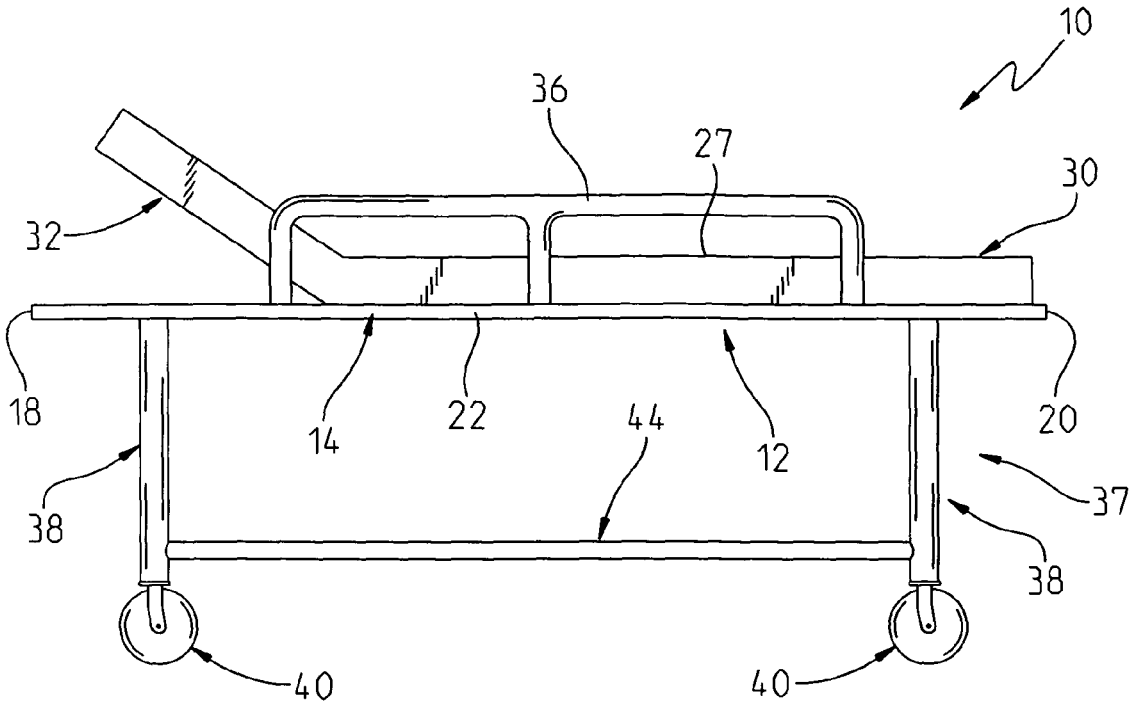
FIG. 1 Prior Art
FIG. 1 is a side view of a prior art gurney without the present invention.
Figure 2:
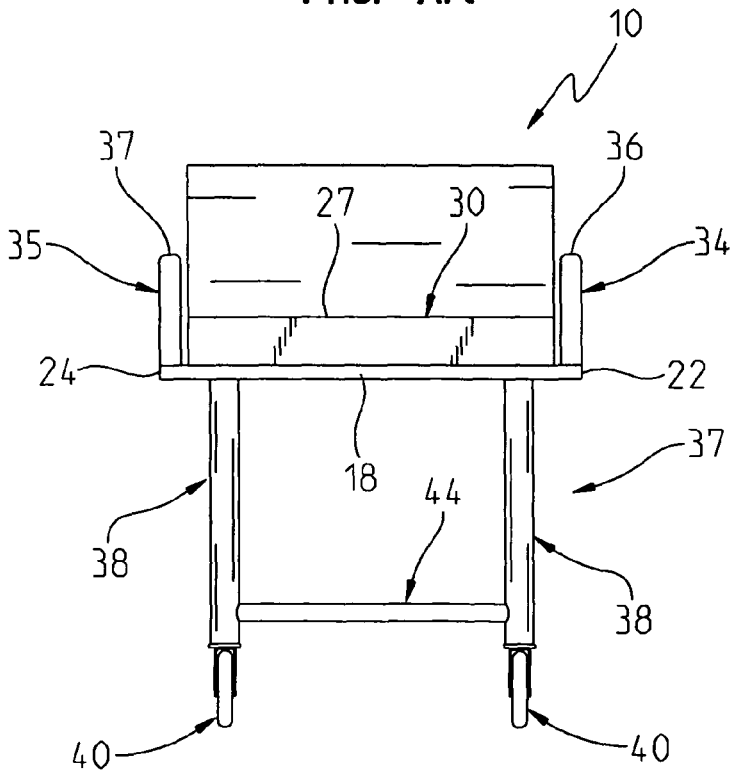
FIG. 2 Prior Art
FIG. 2 is an end view of the prior art gurney of FIG. 1.

FIGS. 1 and 2 show a typical gurney 10 that includes a mattress supporting frame 12, that usually includes a steel or aluminum perimeter member 14. The perimeter member 14 comprises four frame rail members including a head board frame member 18, a foot board frame member 20, a first side frame member 22 and a second side frame member 24. Extending between the interior surfaces of the perimeter member 14 is a base that can comprise a flexible support member (not shown). Often, this flexible support comprises a wire frame member that has a certain amount of springiness to it, to serve as the box spring. Alternately, the support surface can comprise something solid, such as a sheet of plywood, or can comprise a plurality of slats extending between the side frame rail members 22, 24.

A generally rectangularly cuboid mattress 30 is placed upon the upper side surface of the mattress supporting frame member 12. The mattress 30 is typically about six feet in length, and about 24 to 30 inches wide. Because weight is a consideration, most gurney mattresses are rather thin, and are not intended for long term sleeping purposes. The mattress includes a raisable head portion 32 on which a pillow 46 may be placed.

One or more bed side rails 34, 35 are disposed on the upper side surface of the first and second side frame members 22, 24. The bed side rail members 34, 35 are generally parallelogram hinge-type members that are hingedly coupled to the frame member 12 and are movable between a down position, wherein the top of the bed rail does not usually extend above the top surface 27 of the mattress 32, and a raised position, such as is shown in FIG. 1. In the raised position, the cross member of the side rail members 34, 35 extends above the mattress 30, and is positioned for preventing the patient from rolling off of the gurney 10. In the bed 10 shown in FIG. 1, it will be noted that there are two side rails (one on each of the first and second side frame members).

At the head of the bed, a headboard member (not shown) can be fixedly coupled to a side surface of the frame member 18. The headboard can extend upwardly above the mattress 30 for a small distance. In a hospital, a headboard is often used as a patient device securing member to which lights, IV poles, kangaroo pumps and other patient care devices can be anchored.

Although hospital beds tend to have headboards and footboards, headboards and footboards are usually not included on gurneys 10, both to save weight, and also save inconvenience. The mattress supporting frame 12 of the gurney 10 is held above the ground by a support frame 37, that includes vertical legs 38. Four ground-engaging wheels 40 are usually coupled to casters that may be rotatably coupled to the lower ends of the vertical legs 38. A base frame member 44 is provided for structural rigidity.

Some gurneys 10 are designed so that the vertical frame members 38 are fixedly positioned with respect to the side frame members 18, 20, 22, 24, so that they always extend downwardly from and perpendicularly to the side rail frame members 18, 24, and have the wheels 40 at their distal end. However, other gurneys 10, and especially ambulance-specific gurneys have collapsible leg frame members 38, so that the wheel support frame members 38 can extend between a use position wherein they extend generally perpendicular to the ground (FIG. 2), and a transport position. In the transport position, the wheels and frame members often extend generally parallel to the ground. Examples of such gurneys are shown at www.safetybasics.com.

Turning now to FIGS. 3-11, the device of the present invention is shown. The privacy screen assembly 50 of the present invention preferably includes either five or six privacy member segments 52, 54, 56, 58, 60, 62, that collectively form a privacy screen assembly 50. Each privacy screen segment 52-62 includes a first telescoping pole 68, a second telescoping pole 70 and a fabric-like screen member 72 that is extendable between the first 68 and second 70 pole.

Figure 8:
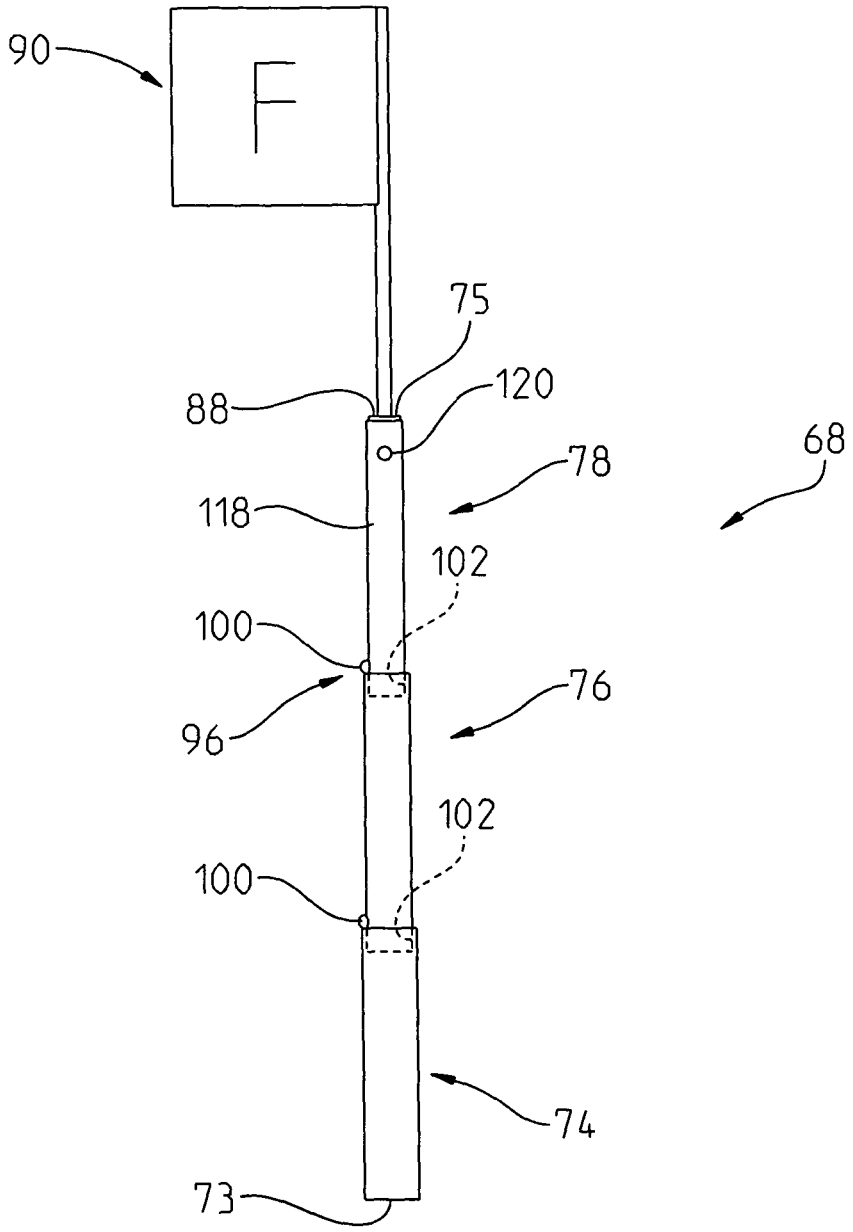
FIG. 8 is an enlarged side view of a telescoping pole of the present invention.

As is best shown in FIG. 8, the first pole 68 is shown as including a first or proximal end 73, a second or distal end 75 (FIG. 8) and a plurality (e.g. three) telescoping segments. The three segments shown in FIG. 8 include a first, or lower segment 74, a second, or intermediate segment 76, and a third, or upper segment 78. The upper segment 78 can include an aperture 88 in distal end 75 for receiving flag 90. Flags 90 are used by hospitals to provide an indicia, of a patient's condition. For example, the flag 90 may designate that the patient has not been seen or that there are orders for the patient; or that the patient has been fed; or that the patient is awaiting treatment; or whatever status indicator is believed appropriate.

Each of the three pole segments 74, 76, 78 includes a gripper member for enabling the position of the pole segment 74, 76, 78 to be selectively fixed (or unfixed) relative to its adjacent pole segment. One example of such a gripper member, is a detent means 96 (FIG. 8). A detent means 96 generally comprises a spring loaded button 100 on one segment (such as an intermediate segment 76) that is extendable through an aperture 102 in an adjacent segment (such as the upper segment 78). If the detent member 96 that is placed adjacent to the upper end of the second segment 76 extends through an aperture 102 that is disposed near the bottom of the upper segment 78, the middle 76 and upper 78 segments will be fixedly positioned in an extended position relative to each other. When so fixedly positioned, the length of the second 76 and third 78 segments together, will generally be approximately equal to slightly less than the length of the second segment 76 plus the length of the third segment 78.

Figure 4:
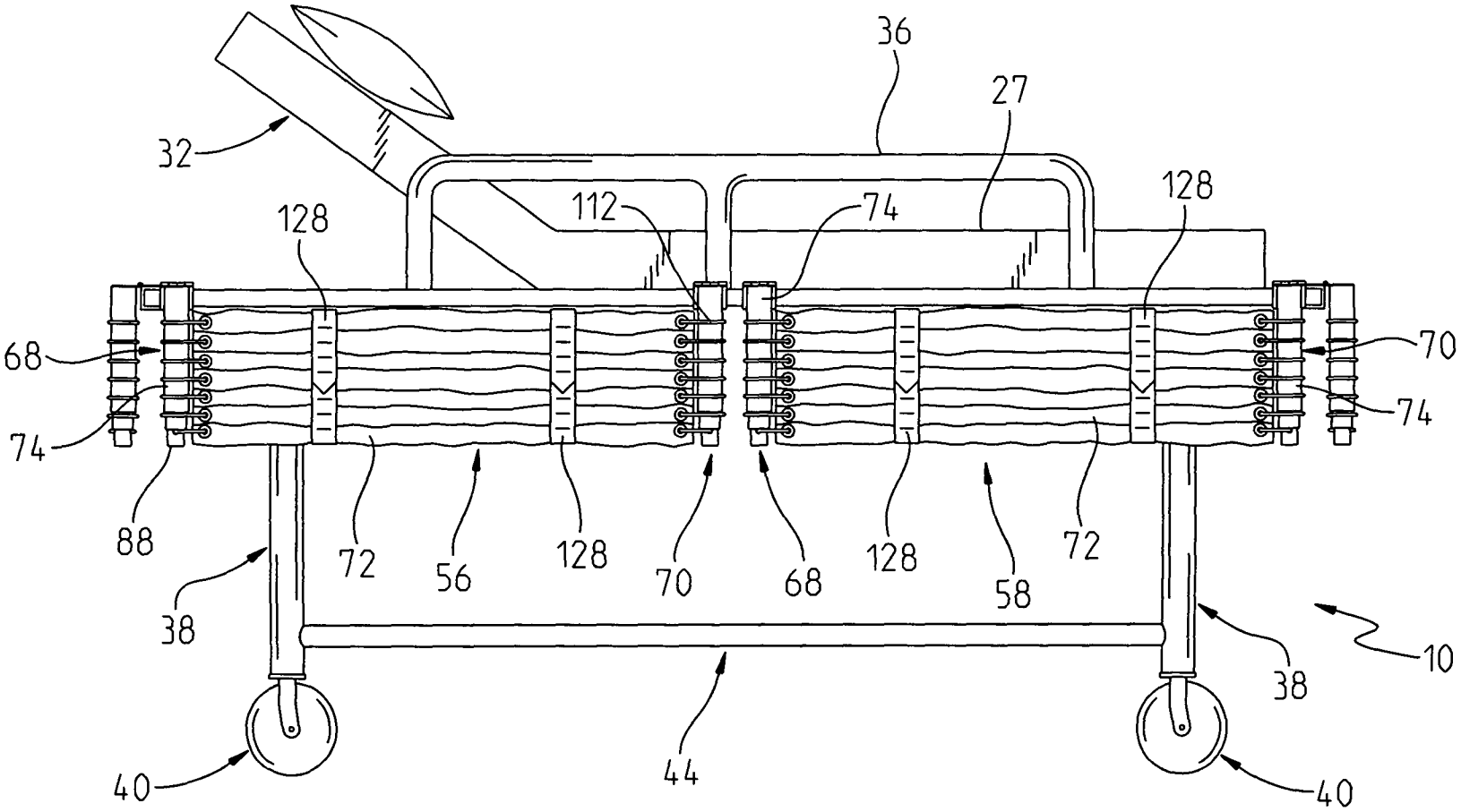
FIG. 4 is a side view of a gurney containing the instant invention, similar to FIG. 3, wherein the screen is placed in its rest or storage position.
Figure 5:
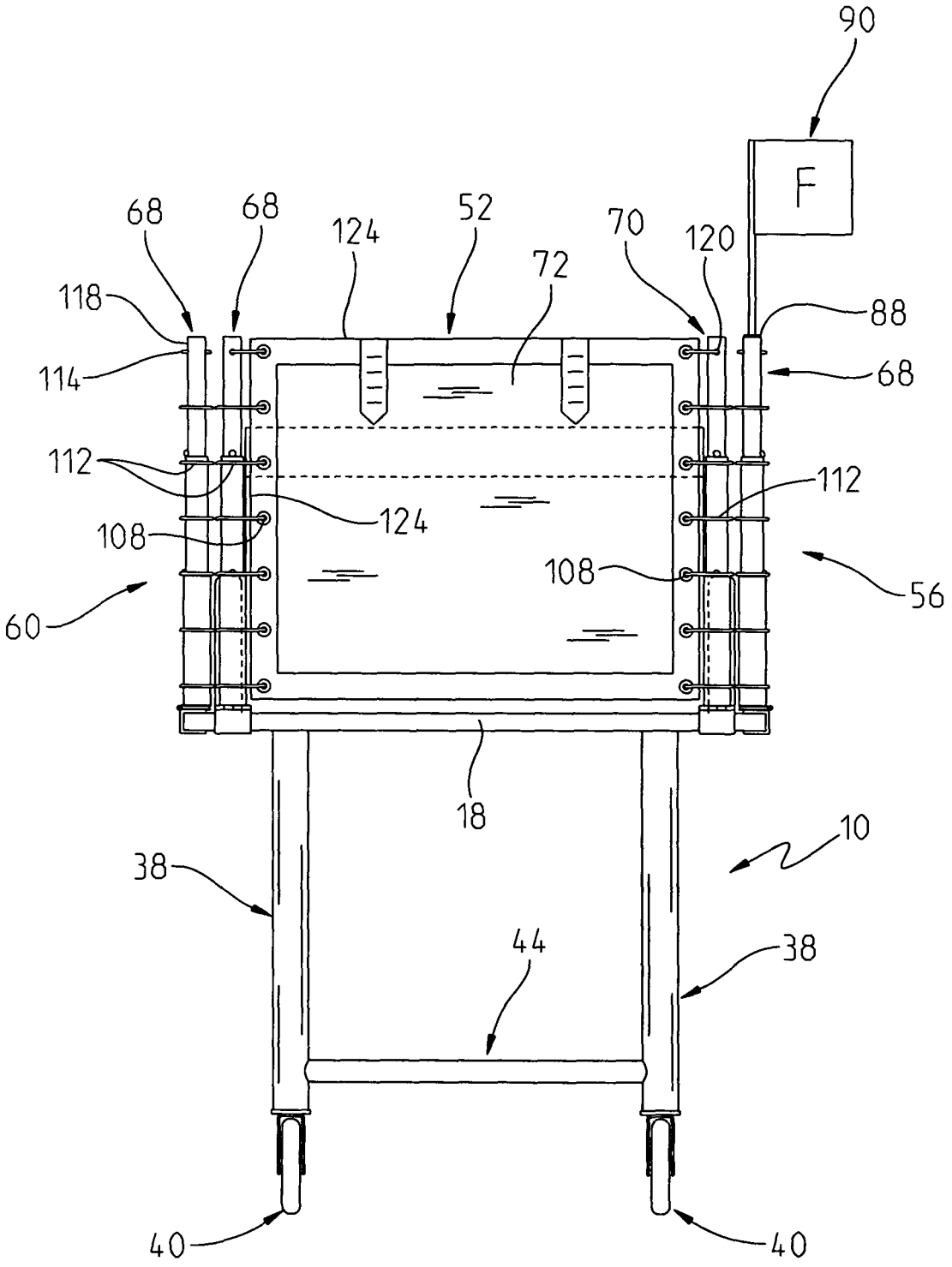
FIG. 5 is an end view of the gurney on which the present invention has been installed, showing the screen of the present invention in the operative (use) position.

The segments 74, 76, 78 of the telescoping poles 68, 70 are movable between an extended position (FIG. 8) and a collapsed position as shown in FIG. 4. In the extended position (FIG. 8), the three segments 74, 76, 78 telescope end to end so that the full length of pole 68, 70 can be achieved. As shown in FIG. 8, the length of the telescoping pole 68 in the extended position is slightly less than the combined total length of the three individual segments together 74, 76, 78. In contrast, when the telescoping pole 68, 70 is in the collapsed position (FIG. 4), the upper segment 78 is preferably nested within the second segment 76, and both of the upper and second segments 76, 78, are nested within the lower segment 74, so that the total length of the telescoping pole 68 generally approximates the length of the longest of the first, second and third segments 74, 76, 78, or is approximately slightly greater than about one-third of the length of the telescoping pole 68 when in a full extended position. The first 68 and second 70 supporting poles are generally similar or identical to each other.

The collapsible fabric-like screen member 72 is sized to extend between the poles 68, 70 when the poles 68, 70 are in their operating (expanded) positions.

Pole-to-screen couplers are provided for coupling the poles 68, 70 to the screen 72. A pole-to-screen coupler can comprise a series of aligned grommet reinforced apertures 108 in the screen 72 through which one of a plurality of rings 112 can pass. Each torroidal ring 112 is sized and positioned to extend around the telescoping pole member 68, 70 and to interiorly receive the telescoping pole member within the central aperture of the ring 112. The screen can include grommet reinforced apertures 108 along both side edges, so that rings 112 can be received for coupling the screen 72 to each of the first telescoping pole member 68 and second telescoping pole member 70.

Preferably, the upper most ring 114 is fixedly coupled to the upper end 118 of the telescoping member 78. For example, an aperture 120 (FIG. 8) can be formed in the upper end 118 of upper pole segment 78, which can be sized for receiving a stud-like portion of the upper most ring 114. Fixedly coupling a ring 114 to a pole segment 78 facilitates the movement of the screen 72 between its expanded and collapsed position, for as the top 117 of the upper telescoping segment 78 moves upward, the screen 72 moves upwardly with it because of the fixed coupling between the screen 72 and the upper telescoping member 78.

Preferably, the side edges 124 of the screen 72 are comprised of reinforced fabric. The fabric used for the screen 72 should be an easily cleanable fabric such as nylon. Preferably, the nylon or other material should include an antimicrobial agent, such as silver impregnated therein.

An example of a silver impregnated material that could be used as a screen 72 of the present invention, is the unique silver bonded fabrics created by Argent Technologies of Watchung, N.J. 07069. More about the fabrics provided by Argent Technologies is available on their website at www.argent47.com.

It has been known for sometime that the incorporation of silver into materials can cause the materials to become less susceptible to microbial infestation, as silver kills such microbes. Microbial infestation is a serious problem in hospitals, nursing homes, and other healthcare facilities, as it is estimated that approximately 1 in 20 patients who are in a hospital will acquire a hospital-acquired infection during their stay in the hospital.

One advantage of the use of silver, is that silver is a broad spectrum anti-microbial agent, that is believed to kill over 650 different types of microbes. Additionally, the incorporation of silver into the screen can help the hospital not only save money by reducing the costs of treating patients who have acquired hospital-acquired infections, but it will also save the healthcare facility laundry costs as the presence of the silver within the fabric and materials is believed to permit the healthcare facility to launder fabrics in cold water, without fear of allowing microbes to thrive, since the silver kills the microbes.

The material from which the screen 72 is made should be thick enough to be durable, but thin enough so that it is flexible enough to collapse easily. The top edge portion 73 of the screen should also be reinforced to prevent breakage of the screen. Preferably, a pair of gatherers, such as Velcro containing straps 128 are used in a gathered position when in the collapsed position (FIG. 4). The strap preferably includes a first end having one half of a hook and eye cloth fastener (e.g. Velcro® brand fastener) and a second end having the other half of the hook and eye fastener. To gather the compressed screen 72 material, the strap 128 is wrapped around the screen, and then the first and second ends of the strap are joined together so that the strap 128 forms an endless loop that internally receives the screen 72

In order to collapse the screen 72, the detent means 96 of each of the telescoping poles 68, 70 are de-coupled, so that the three telescoping members 74, 76, 78 are nesting co-extensively within each other. When this occurs, the sides of the screen 72 will stand upwardly approximately 11 inches (in the preferred embodiment).

Figure 6:
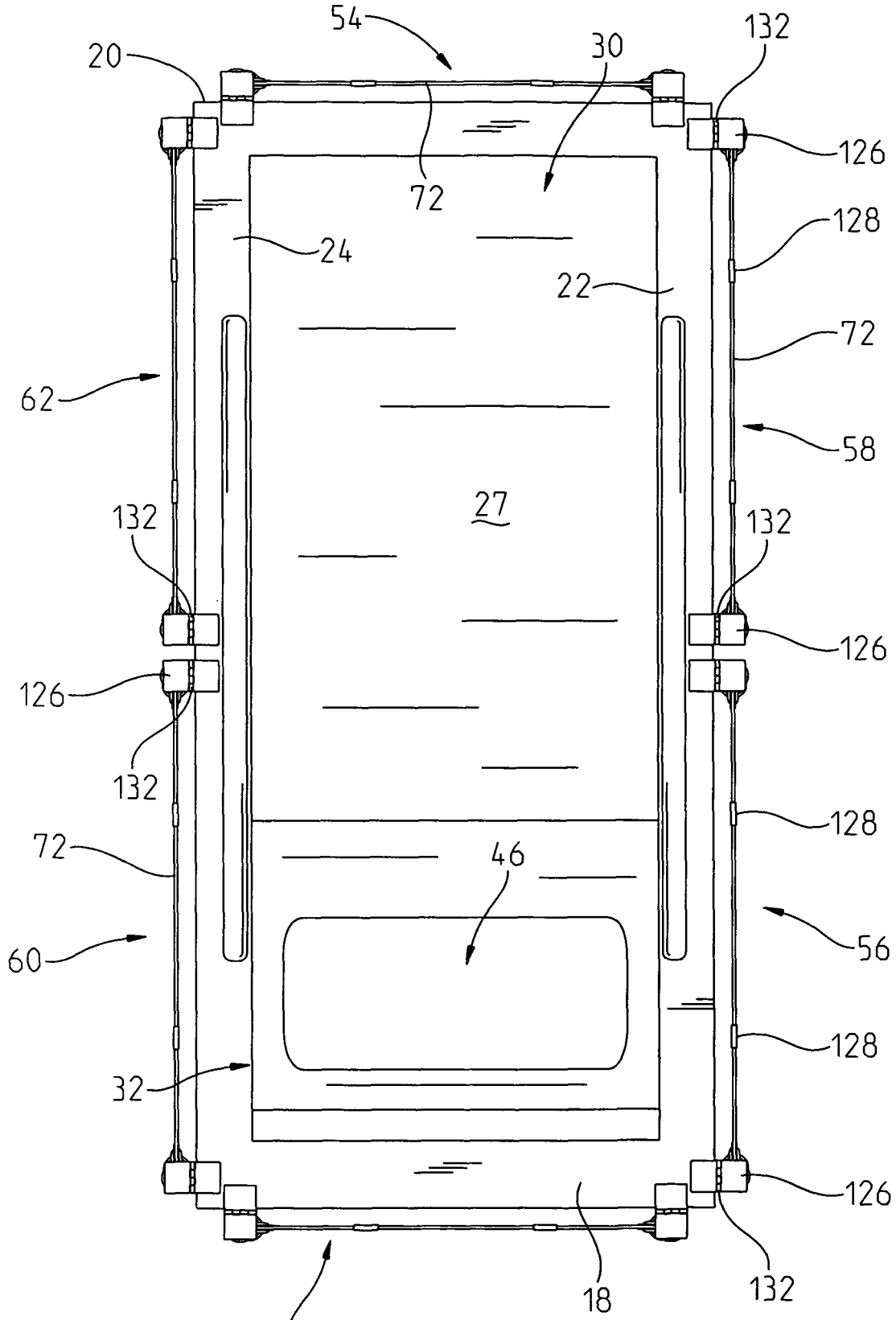
FIG. 6 is a top view of the gurney showing the screen of the invention attached thereto, in the compressed or storage position.
Figure 7:
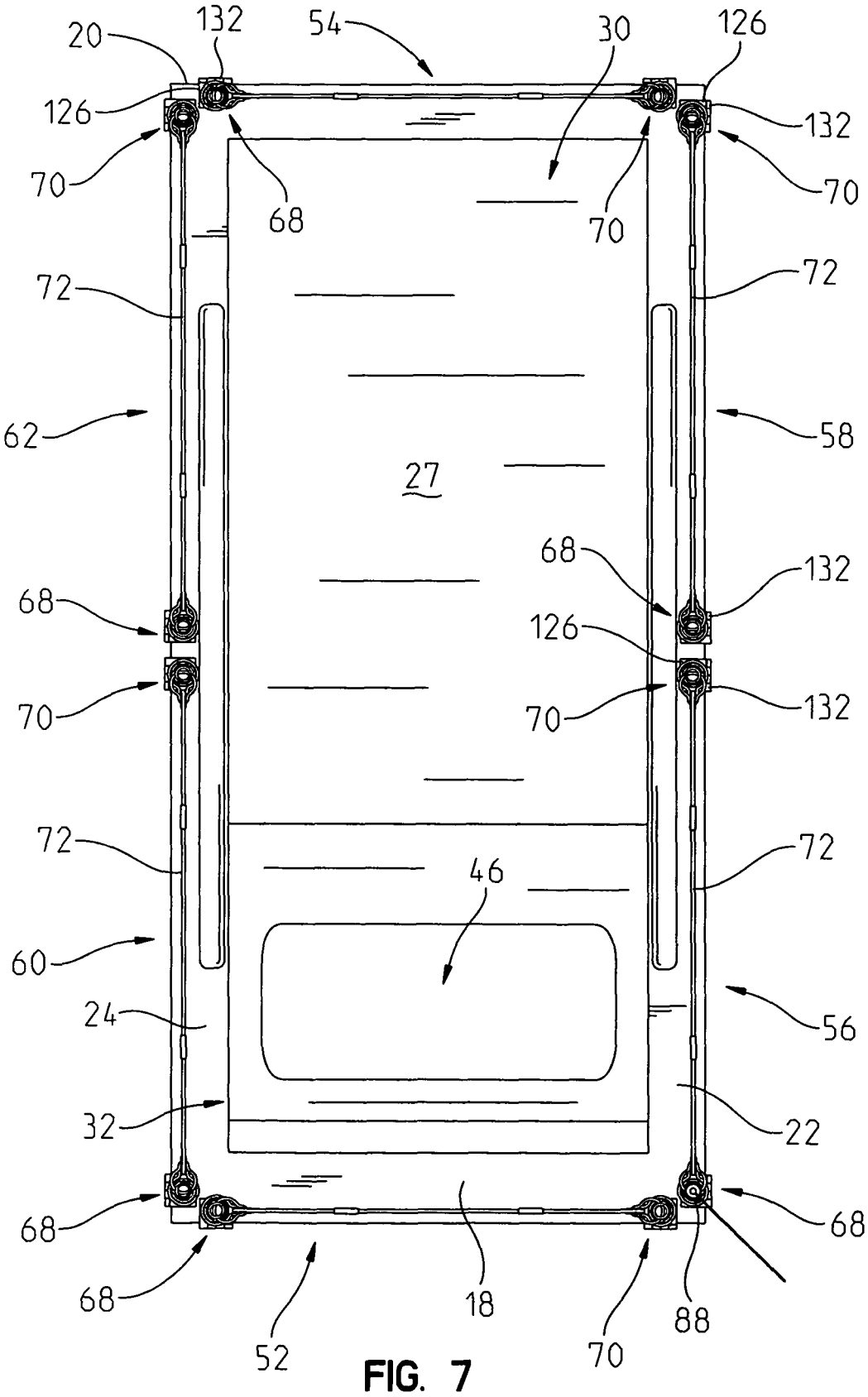
FIG. 7 is a top view, similar to FIG. 6, except showing the screen of the present invention in the expanded (use) position.

The bottom segments 74 of each of the telescoping members 68, 70 are preferably coupled to a first and second coupler respectively in the form of a hinge clamp 126 containing a hinge 132 for hingedly coupling the poles 68, 70 to the frame member 18-26 of the gurney 10 (FIGS. 6, 7). The hinged coupler 126 should be a fixable hinge coupler, that can enable the telescoping poles 68, 70 to be fixed in an upright position, such as is shown in FIG. 3, but then can be uncoupled, to enable the hinges and telescoping members to pivot downward about hinge 132 to a lowered position, as shown in FIGS. 4 and 6.

In FIG. 4, it will be noted that the telescoping members 68, 72 rather than extending upwardly above the rail 22, have been rotated 180 degrees to extend downwardly below the rail 22. Because the screen 72 is in its collapsed position, the screen 22 will be restrained from extending downwardly far enough to hit the ground. In order to keep the screen from contacting the ground, the strap members 128 (that can contain Velcro-like hook-and-eye fastening member), are wrapped around a bunched screen 72 to keep the bunched screen 72 in a bunched position, and to keep it above the ground as shown in FIG. 4.

Figure 3:
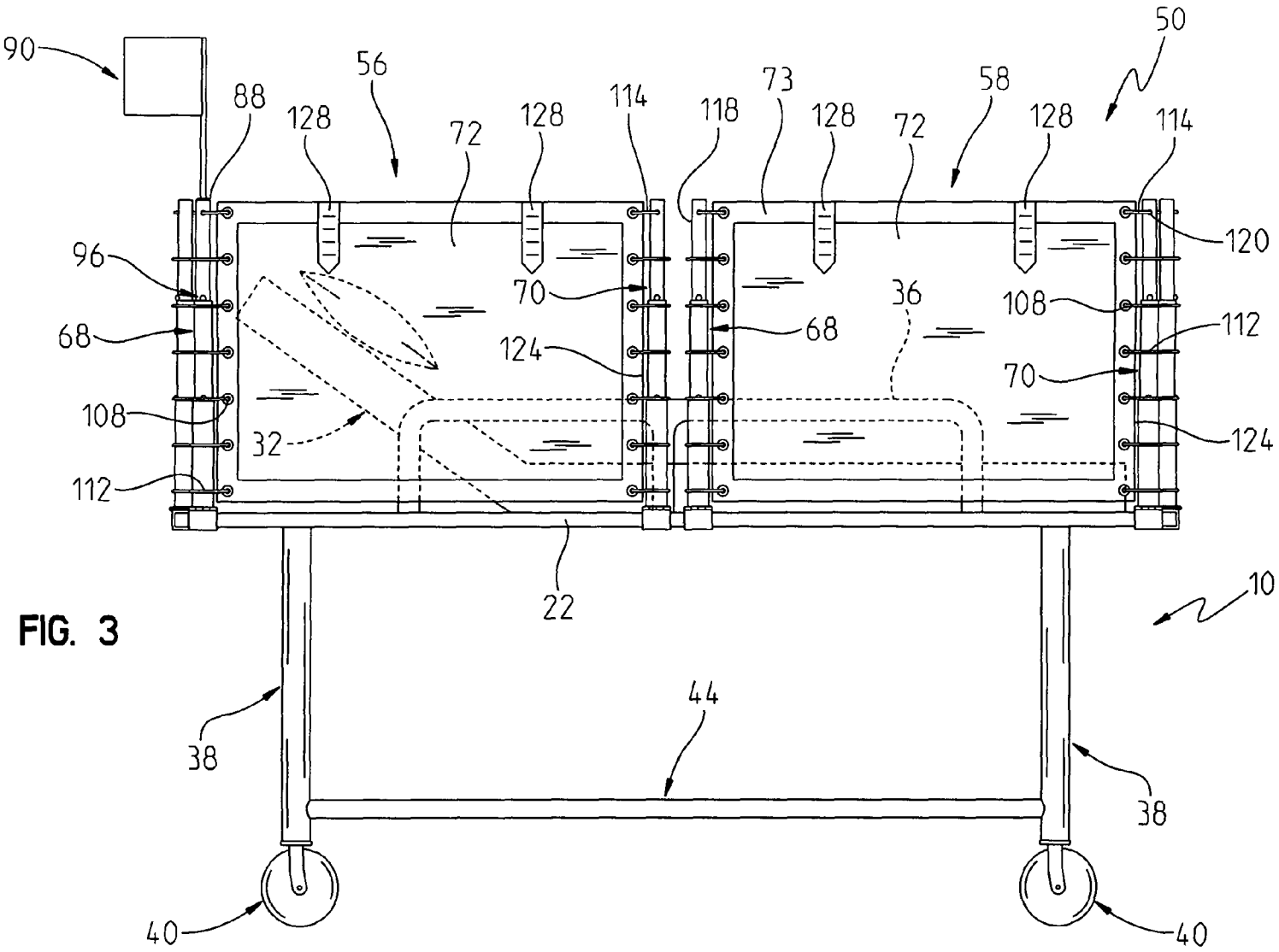
FIG. 3 is a side view of the gurney of FIG. 1, showing the screen of the present invention installed thereon, with the screen in the operative, extended position.

To move the screen 72 from the bunched position (FIG. 4) to an upright position (FIG. 3), the first and second telescoping members 68, 70 are first rotated 180 degrees on hinge 132 about the gurney frame 22, to move from the downward position (FIG. 4) into the upright position (FIG. 3). Telescoping members 74, 76, 78 are then moved axially to be pulled out of each other, so that they are no longer fully nested within each other, but rather disposed in the end-to-end relationship extended position as shown in FIG. 3. The detent means 96 gripping members (FIG. 8) are then coupled and engaged, to maintain the telescoping members 74, 76, 78 segments in their extended end-to-end position.

As the upper telescoping member 78 is moved away from the lower telescoping member 74, a fixed coupling between the upper ring 114 and the upper telescoping member 78 pulls the screen 72 away from its bunched position, into its extended position as shown in FIG. 3. Before extending the upper telescoping member 78, the user must first undo the hook and eye fastener at the first and second ends of the straps 128, for if the straps 128 remain wrapped around the screen 72, the screen 72 will be unable to unfold properly.

The screens 72 are preferably nylon, so they can be designed to be cleaned easily between patients. Cleaning is preferably performed with either a chlorine solution, or some other antimicrobial solutions. Several commercially antimicrobial solutions exist, that can be sprayed onto a surface, and will kill on contact, or that can wiped across the surface, to kill germs on contact.

Figure 9:
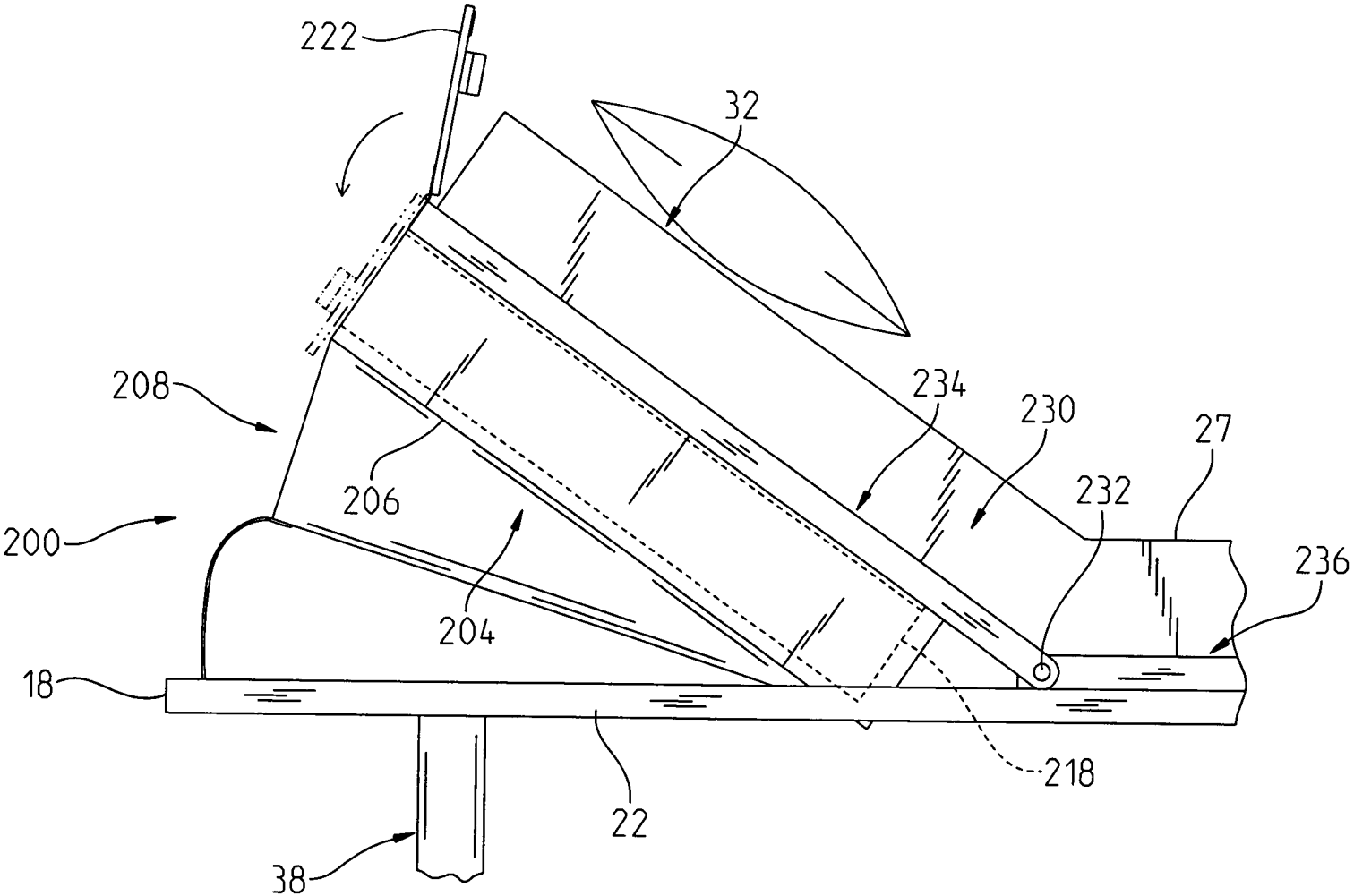
FIG. 9 is an enlarged side view showing the lockable, under-gurney storage member of the present invention in its access position.
Figure 10:
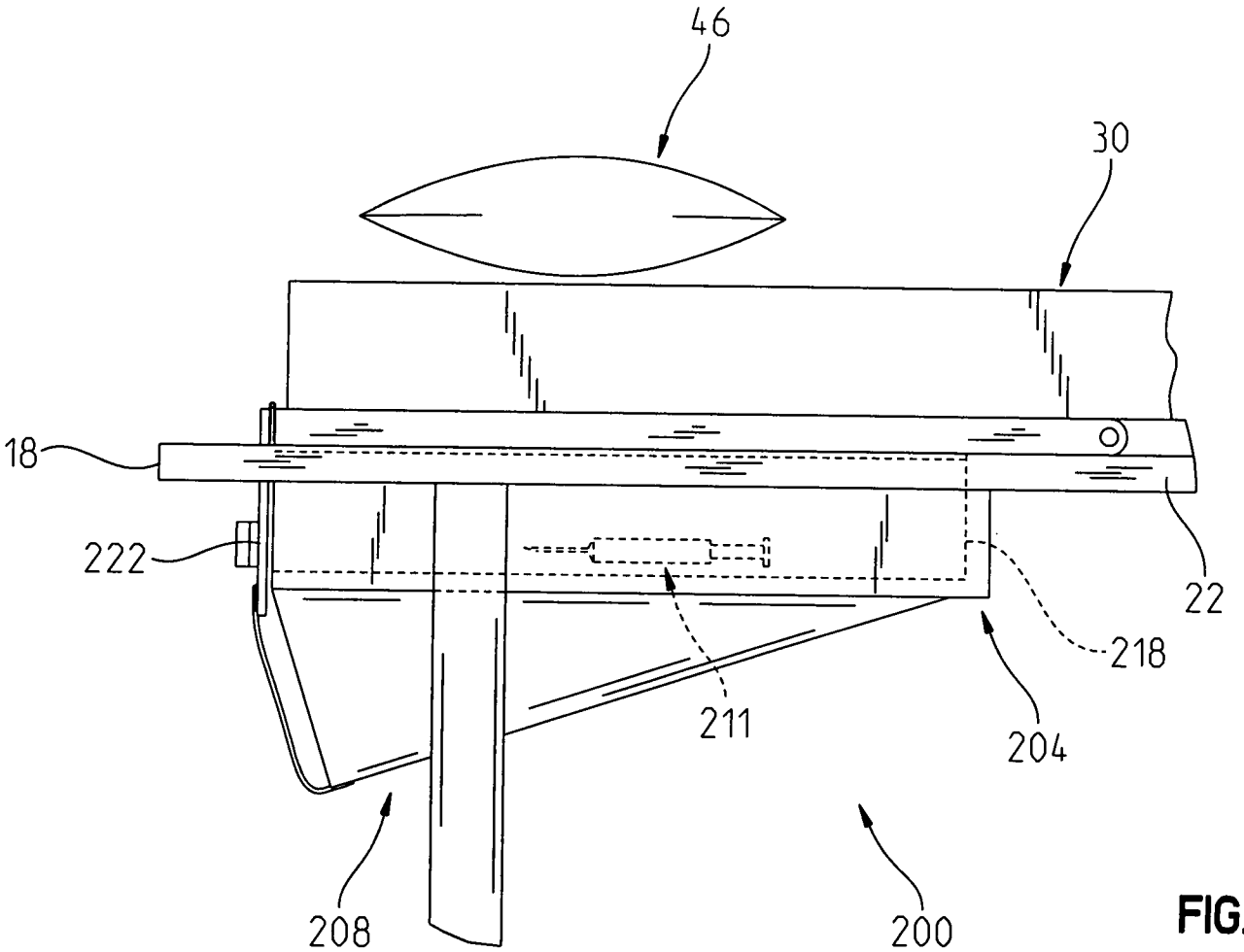
FIG. 10 is a side view similar to FIG. 9 of the under gurney storage member of the present invention, except showing the storage member in the storage position.
Figure 11:
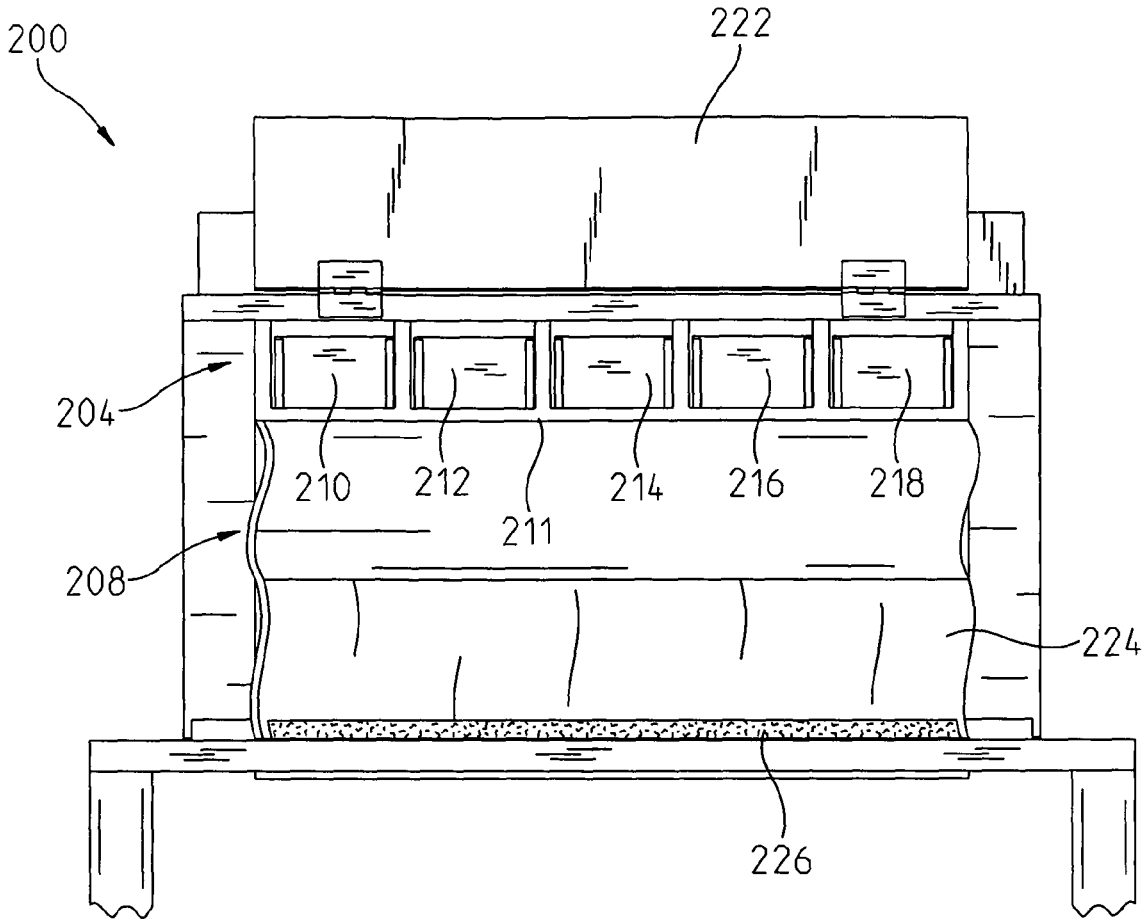
FIG. 11 is an end view of the storage member of the present invention, showing the flap cover thereto open, so that the user may gain access to the interior of the storage compartment.

Another aspect of the invention relates to the storage container that is useable in connection with gurneys 10 and is best shown in FIGS. 9-11.

It is helpful to have certain standard supplies close to a patient when treating a patient. Having these supplies close to the bed 10 where the patient resides saves valuable time when treating a patient. Examples of such supplies includes things like syringes, bandages, EKG leads and electrodes, biops, probes, Vacutainers®, tourniquets, 4×4 sponges, cotton balls and the like. In a typical hospital or treatment room, there is usually a cabinet that is positioned close to a bed where these supplies are contained. However, a gurney 10 that is placed in a hospital hallway or ER hallway does not have these items nearby.

An additional complicating factor with some of these products is that they must be locked up to prevent theft, as they are controlled access products. Among these controlled access products are syringes that are generally not given to the public without a prescription or some other need. Therefore, there is a need to have a mini supply cabinet 200 on or near the gurney bed 10.

In accordance with the present invention, a supply device 200 is provided. The supply device 200 includes a "hard (rigid) compartment" 204 and "soft (non-rigid) compartment" 208. The hard compartment 204 contains a hard case 206, and one or more end-opening drawers 210, 212, 214, 216, 218 into which various supplies can be placed. A locking member 222 is provided for locking the drawers 210-218 (when not being used) to prevent unauthorized access to the supplies in the drawers 210-218. The soft (non-rigid) compartment is attached to the hard compartment. The soft compartment 208 includes a closure member 224 such as a Velcro-containing flap 224. However, the soft compartment 208 need not necessarily include a locking assembly, as the soft compartment is provided for holding non access controlled components such as 4×4s, IV dressings and the like, which are not "controlled materials".

The hard compartment 204 includes an attachment member for attaching the hard compartment 204 (and the entire container) (not shown) to the underside of the bed frame. Preferably, when the device 200 attached to the underside of the head portion of the gurney bedframe 12, and the head portion of the gurney bedframe is raised into a semi-sitting position (see FIG. 9), one will have access to the hard 204 and soft 208 compartments through the head end of the bed.

Turning now to FIG. 9, a hospital bed 10 is shown as including a gurney, a primary frame 22, and mattress supporting frame 230. The mattress supporting frame 230 is hinged at hinge 232, and includes an upper portion 234 that is movable between a rest position that is generally parallel to the lower portion 236, and a lifted position that is shown in FIG. 9 as being disposed at an angle to the lower portion 236. A mattress 27 is then placed on the upper side surface of the mattress support member. The container device 200 is coupled to the underside surface of the mattress support member 230.

The hard compartment 204 portion includes a plurality of end-opening enclosures into which drawers 210-218 can be placed. The front of the upper hard portion 204 is generally open to enable the drawers 210-218 to slide in and out. The roll top member or hinged lid member 222 can be extended over the front, and locked to the drawer member, to prevent unauthorized persons from gaining ingress into the materials contained within the drawers 210-218.

The soft compartment 208 is disposed under the hard compartment 224. The soft compartment 208 comprises a softer fabric-like material such as anti-microbial silver containing vinyl, which is suspended, under the hard compartment 204, and is capable of collapse. Preferably, the materials that are not susceptible to breakage when collapsed are placed in the soft compartment 204. A flap member 224 is provided for closing the front end of the soft portion. The flap member 224 includes a Velcro® closure member 226 at its distal end for fixedly coupling the flap, in the closed position. Additionally, the flap 224 can include pockets, for holding additional materials.

Figure 12:
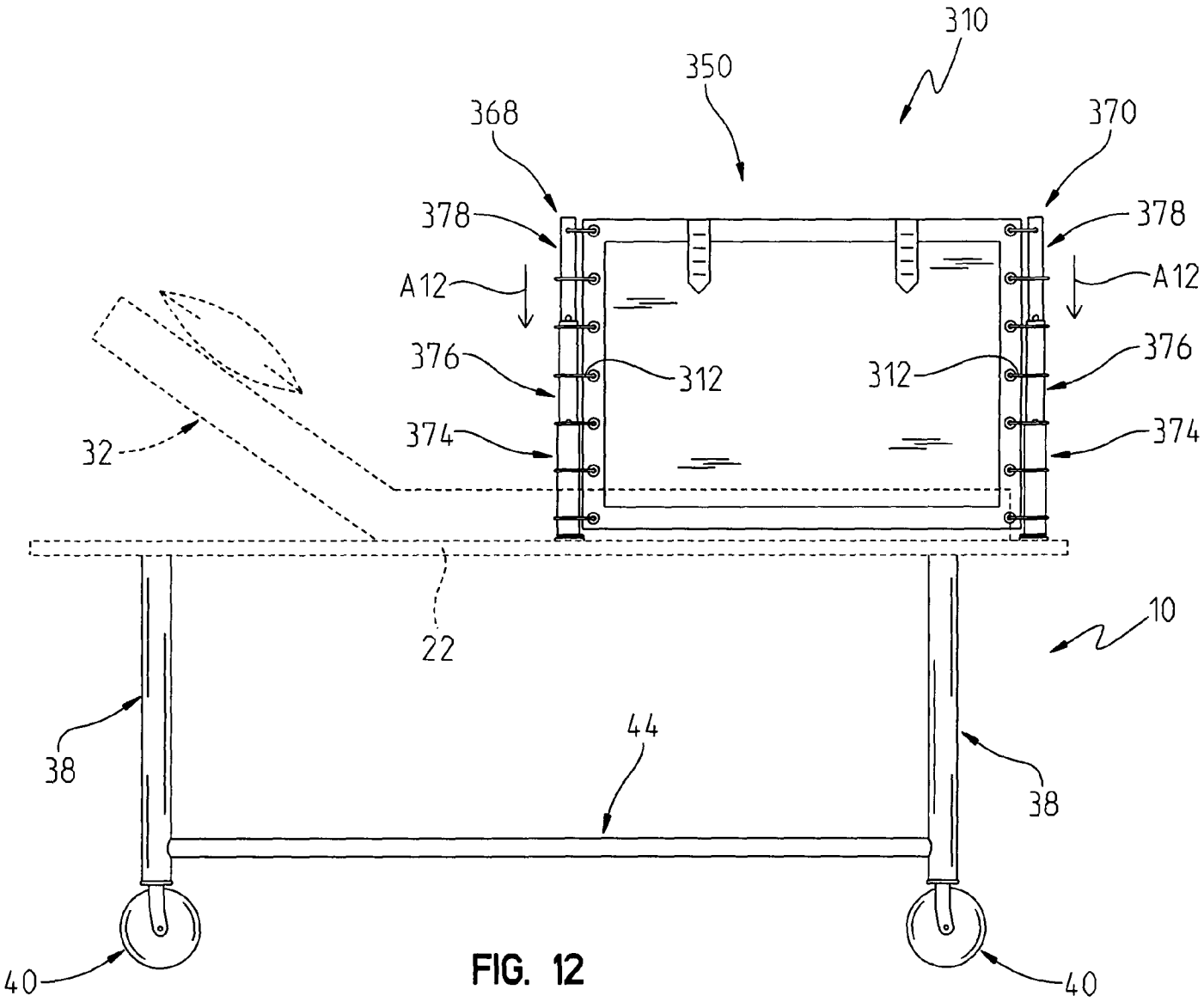
FIG. 12 is a side view of a first alternate embodiment screen 310 of the present invention, showing said screen on a gurney in its fully expanded position.
Figure 13:
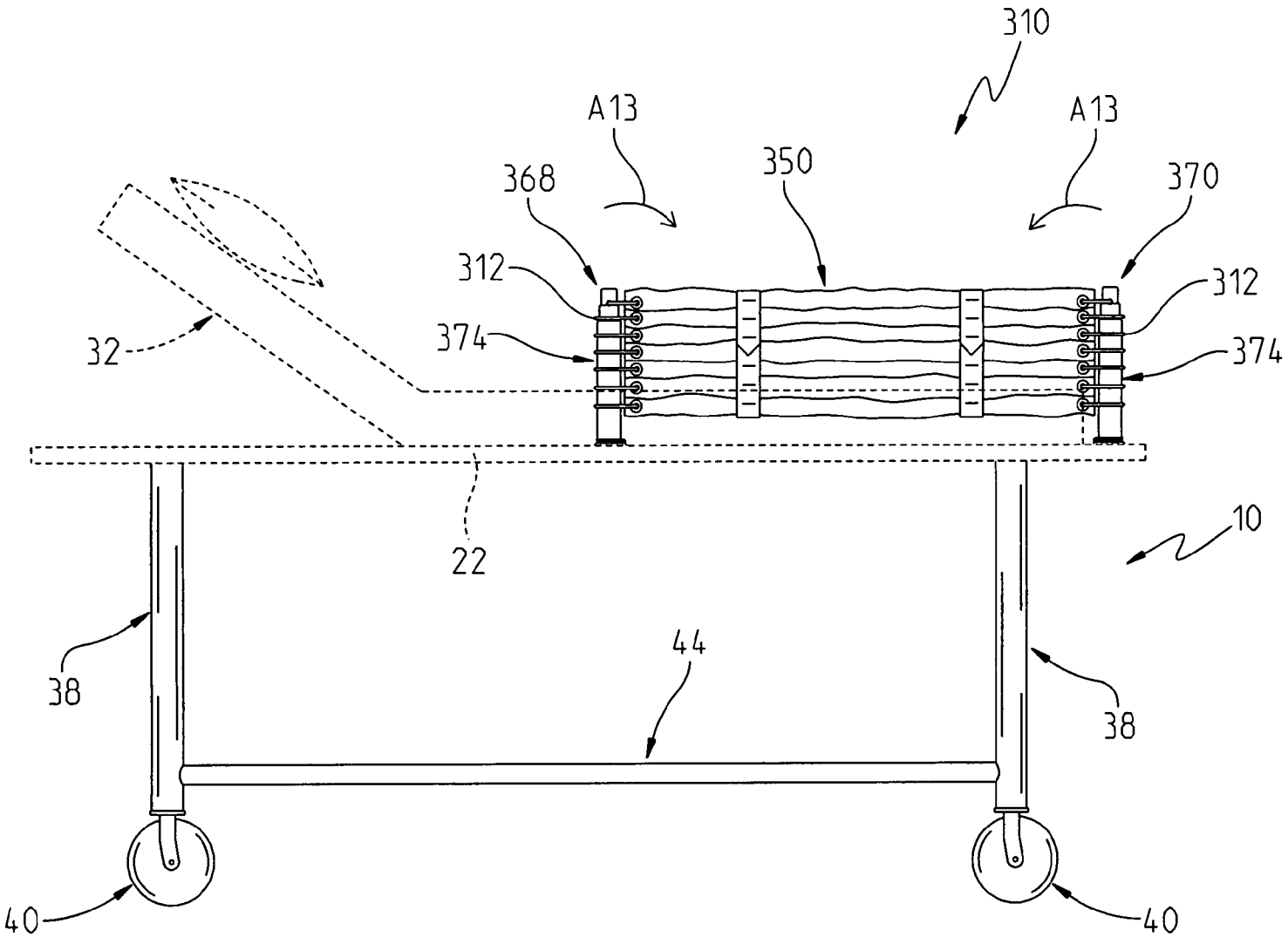
FIG. 13 is a side view of the alternate embodiment screen 310 shown in FIG. 12 showing said screen in the partially collapsed position.
Figure 14:
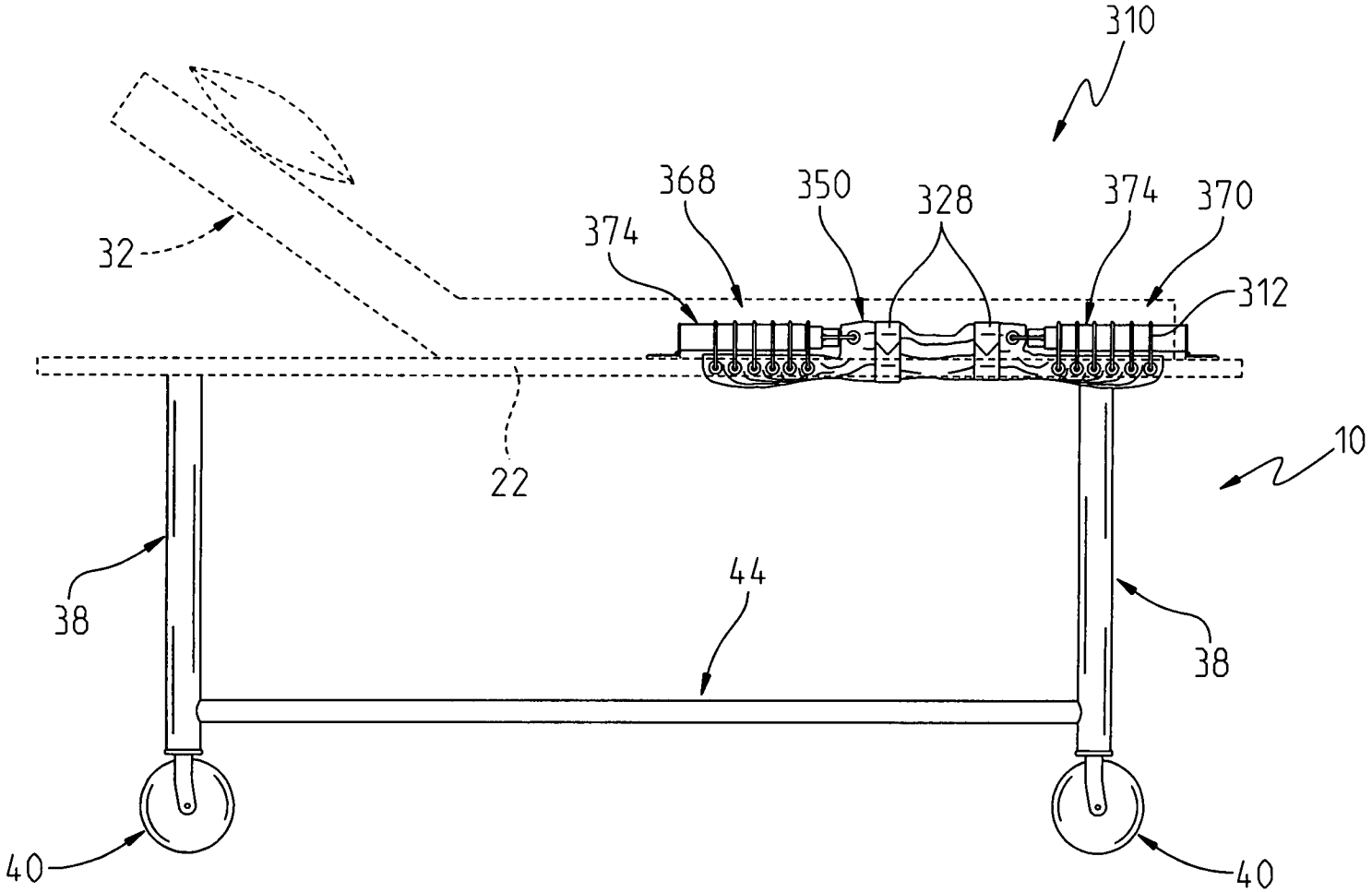
FIG. 14 is a side view of the alternate embodiment screen of FIGS. 12 and 13, showing the screen 310 in the fully collapsed, storage position.

An alternate embodiment screen 310 is shown in FIGS. 12-14. Alternate embodiment screen 310 is designed primarily for use with older gurneys. With older gurneys, the frames are configured so that the screen 310 cannot be placed exteriorly of the side rails. Rather, the screen 310 must be placed interiorly of the side rails. The interior placement prevents the screen from moving into its fully collapsed position, shown in FIG. 4. Turning back to FIG. 4, it will be noted that the telescoping poles 68, 70 extend generally downwardly, along axis that are generally parallel to the axis of the vertical extending legs 38.

Returning back to FIGS. 12-14, the telescoping legs 368, 370 of the screen 310 cannot be placed in this downwardly extending position because of the exterior placement of the rails. As such, the alternate embodiment screen 310 must be configured to be placeable in a storage position similar to that, shown in FIG. 14, wherein the first and second telescoping members 368, 370, when fully collapsed, are disposed along the upper surface of the rail 22, in a position where the telescoping members are disposed generally co-linearly, and wherein the axis of the telescoping member 368, 370 is disposed generally perpendicularly to the axis of the vertical legs 38.

As shown in FIG. 12, the alternate embodiment screen 310 in its expanded position, is generally similar to the first embodiment screen. The telescoping members 368, 370 are shown as being comprised of three sections, including a lower (first) section 374, a middle (second) section 376 and an upper (third) section 378. The first, second and third sections 374, 376, 378 are telescopically received within each other, so that when they are in the expanded position, they are placed in an almost end-to-end relationship, but when they are collapsed (FIG. 13), they are placed in a nested co-extensive position. When in the nested position, the overall length of the telescoping members 368, 370 is slightly greater than one-third of the total length of the telescoping poles 368, 370 when in their expanded position. A plurality of rings 312 are provided that include central apertures for interiorly receiving poles 368, 370. The rings also extend through grommets arranged along the side edge of the fabric-like screen 350.

When the screen 310 is moved from its fully extended position (FIG. 12) to its partially collapsed position (FIG. 13), the second and third telescoping members 376, 378 are moved in an axial direction, indicated generally by arrows A12. When the second and third telescoping members 376, 378 are fully nested within the first telescoping member 374, the device 310 is then capable of being placed into its fully collapsed and storage position. When in the partially collapsed position (FIG. 13) the fabric screen member 350 is also collapsed and somewhat "bunched up".

After the telescoping members 368, 370 are fully collapsed and nested, the telescoping poles 368, 370 are then hingedly pivoted about hinge members, so that they move in a direction indicated generally by arrows A13 of FIG. 13, so that the telescoping members move into a position shown generally in FIG. 14, wherein the telescoping members are disposed generally parallel to the side rail 22, and are also disposed in a position wherein the telescoping members 368, 370 are generally co-linearly disposed, and extend along an axis generally perpendicular to the major axis of the vertically extending legs 38.

Strap members 328 are then used to gather up, contain and secure the fabric of the fabric screen 350, in a manner similar to strap members 28 of the device shown in FIG. 3. When the straps are engaged, the fabric like material will be gathered up, and will be prevented from drooping along side of the cart.

Figure 18:
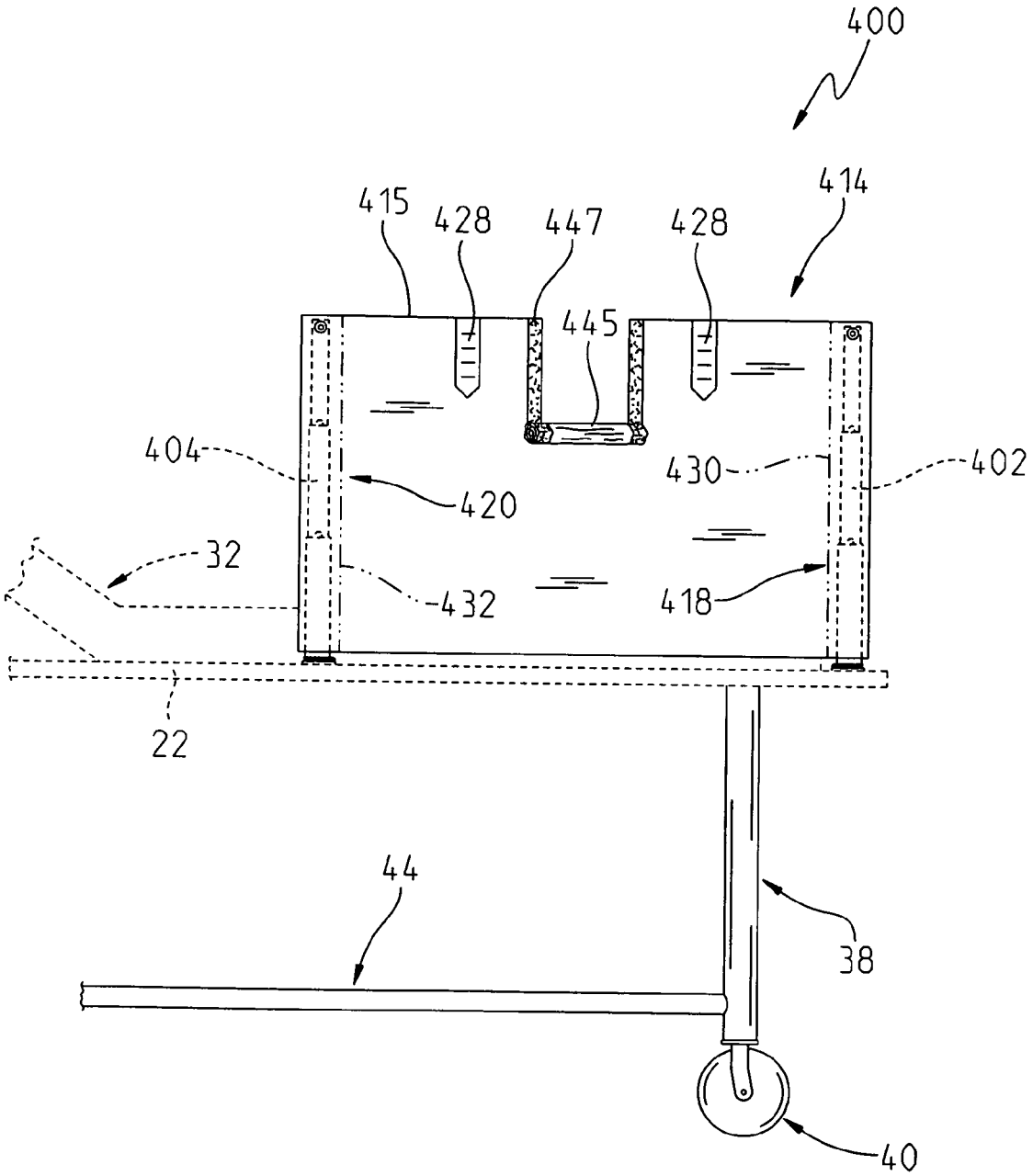
FIG. 18 is a side view of a gurney wherein the second alternate embodiment, sleeve-type screen of the present invention is shown wherein the screen is in its operative or use position.
Figure 19:
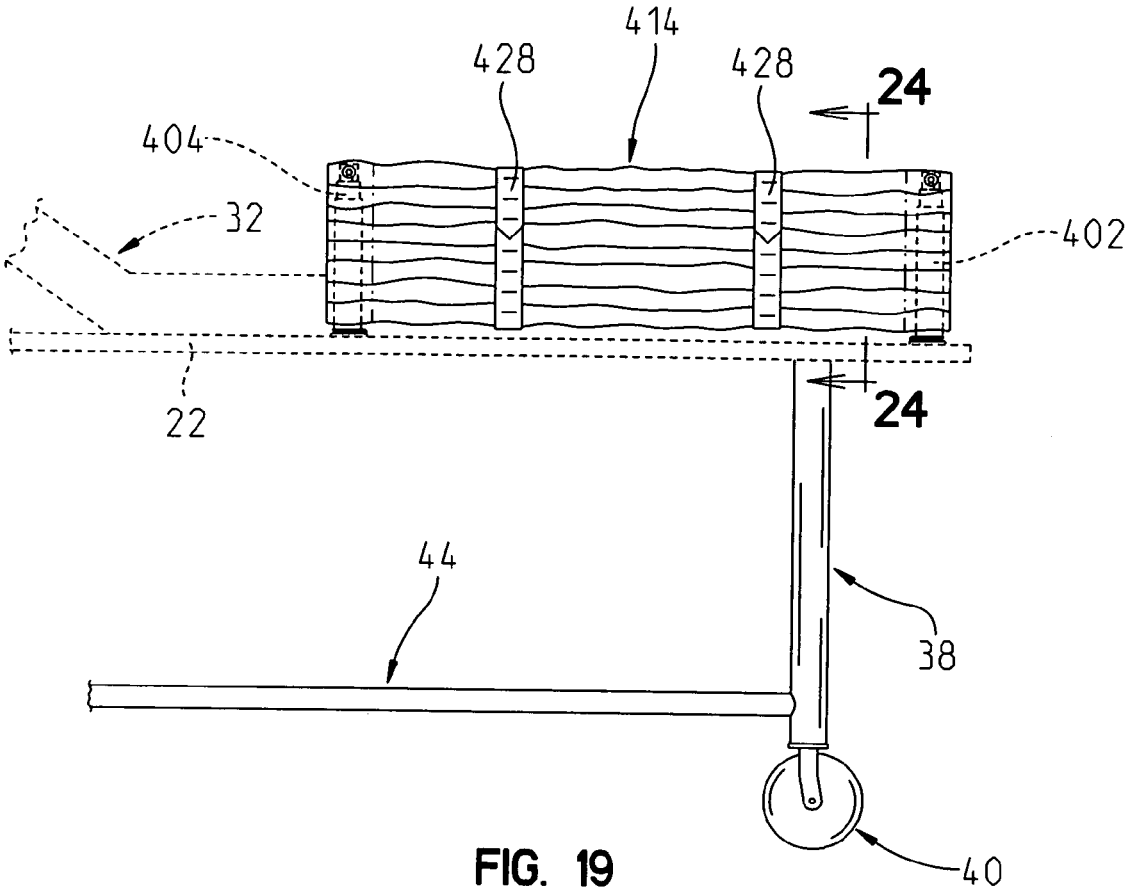
FIG. 19 is a side view of the second alternate embodiment sleeve-type screen shown in FIG. 18, wherein the screen is in its partially collapsed position.

A second alternate embodiment screen system 400 is shown in FIGS. 15-20. In many respects, this alternate embodiment sleeve-based screen system 400 is similar to the other screen systems, as it comprises a plurality of screen segments that are designed to encircle a gurney 10, and that are coupled to the frame of the gurney 10. Similar to the other systems, the screen 414 is movable between an expanded position as shown in FIG. 18 and the collapsed position as shown in FIG. 19.

Although not shown in the drawings, the screen 414 is also movable into a storage position, through the hinged coupling of the poles 402, 404 to the frame 22 of the gurney. This hinged coupling permits them to move from an upstanding or operational position, as shown in both FIGS. 18 and 19, and a lowered position, where the poles are rotated 180° about an axis of frame 22, so that the support poles 402, 404 extend downwardly, rather than upwardly.

Support poles 402, 404 are generally similar to the other support poles discussed herein as they are multi-segment, telescoping poles, that can move from a collapsed position as shown in FIG. 19, wherein the support poles 402, 404 segments are disposed generally co-extensively, to a position that is shown in FIG. 18 wherein the pole segments are disposed in an end to end relationship. Detents are provided for fixedly coupling the pole segments in the extended position as shown in FIG. 18.

One difference between the poles 402, 404 shown in the sleeve embodiment 400 and the poles 68, 70, of FIG. 3, is that the support poles 402, 404 include a chain 410 coupled to their upper ends, to which a pin 408 is attached to the distal end of the chain 410. The pin 408 is designed for insertion through a horizontally disposed aperture 412 that extends in a direction generally perpendicular to the axis of the pole 402, 404 and that is disposed adjacent to the upper end of the respective poles 402, 404.

The screen 414 is generally rectangular, and cloth-like and is preferably made from a material similar to the material from which the other screens discussed in connection with FIGS. 1-14 are made. The screen 414 includes a top edge 415 and a bottom edge 417. The top and bottom edges 415, 417 are generally sized to be long enough to extend between the two poles 402, 404. The screen also includes a central portion 416, that is disposed between a first, generally vertically disposed side sleeve 418, and a second, generally disposed side sleeve 420. The first and second side sleeves 418, 420 extend between the top and bottom edges 415 417, and extend in a direction generally perpendicular to the extent of the top and bottom edges 415, 417.

The first end side sleeve 418 includes an open top end 422 and an open bottom end 426. Similarly, the second side sleeve 420 includes an open top end 424, and an open bottom end 427. The open bottom end 426 and open top end 422 permit the sleeve to be slid over the first pole 402, in a manner generally similar to the manner in which the sleeve in the sail of a Laser brand sailboat can be slid over the mast of the Laser sailboat. Similarly, the open bottom end 427 of the second side sleeve 420 permits the hollow sleeve to be received within the interior of the second side sleeve 420.

The first side sleeve is formed by providing a sewn, first vertical seam 430 that extends between the top edge 415 and the bottom edge 417 at a spaced relationship from the edge of the screen 415, to provide an appropriately sized sleeve 418 for receiving the first pole 402. Similarly, a vertically extending sewn seam 432 is provided for defining and forming the second side sleeve 420.

Velcro®-containing straps 428 are provided for enabling the user to bunch and hold the screen 415 when in the collapsed position as shown in FIG. 19. A grommet-reinforced aperture 436, 438 is coupled to the first and second end sleeves 418, 420, adjacent to the top ends 422, 424 of the first and second sleeves 418, 420.

The grommet-reinforced apertures 436, 438 preferably comprise a pair of grommet-reinforced members 436, 438 that are aligned as shown in 417. The apertures are alignable with the transverse pin-receiving aperture 412 in the pole 402, so that the securing pin 408 can pass through the grommet-containing apertures 436, 438 and the transverse aperture 412 to fixedly couple the screen 415 to the poles 402, 404.

As described in connection with the screen shown in FIG. 1, this fixed coupling permits the screen to be raised and lowered together with the raising and lowering of the poles 402, 404. If for some reason one wishes to raise and lower the poles 402, 404 separately from the screen 414, one can do so by removing the pin 408 to decouple the screen 414 from the poles 402, 404.

Figure 24:
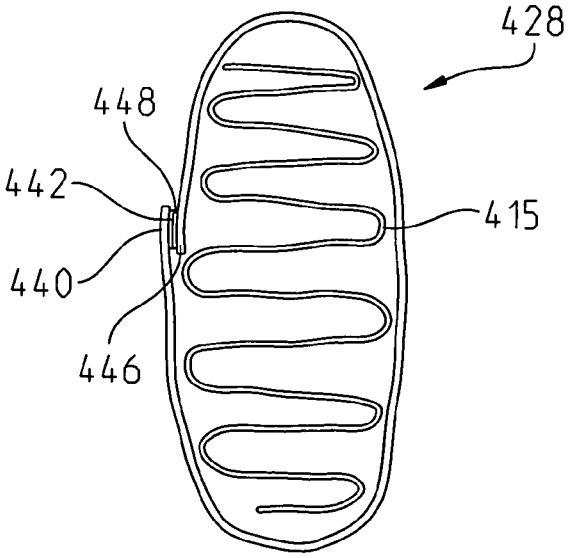
FIG. 24 is a sectional view taken along lines 24-24 of FIG. 19.

The strap system 428 is best shown in FIG. 24. The strap 428 includes a first end 440 to which a first half of a hook and eye material pair 442 is attached, and a second end 446 to which a second half of a hook and eye material pair 448 is attached.

When the screen 414 is in its expanded position as shown in FIG. 18, the first and second ends 440, 442 are detached from each other. However, when the screen 414 is in its bunched or gathered positions, the first half of a hook and eye material portion 442 of the first end 440 is attached to the second half of a hook and eye material second end 446 with the first and second ends 440, 442 being positioned to surround the bunched screen material 415, so that the strap 428 forms an endless loop around the screen material 414. When this occurs, the strap has an appropriate size to maintain the screen material 415 in a tight bunch, and maintain the screen in a sufficiently gathered configuration, to prevent it from dragging on the ground.

Figure 15:
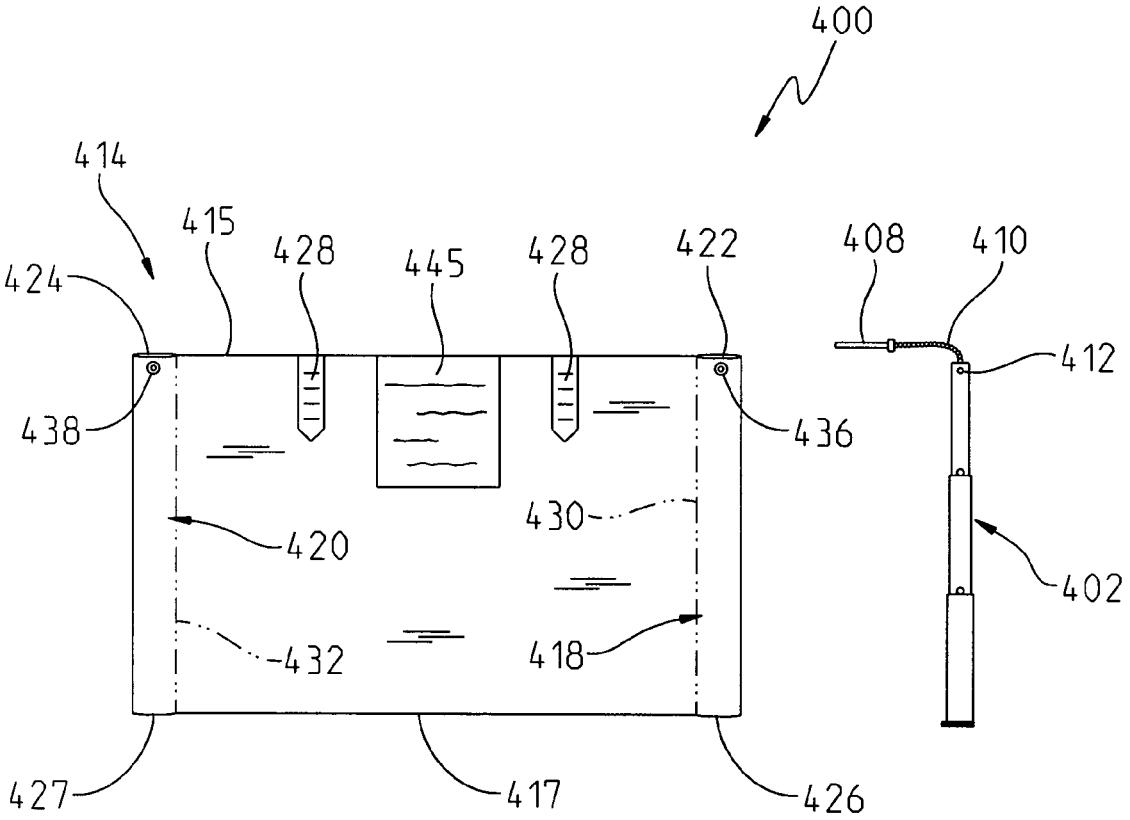
FIG. 15 is an exploded view of a second alternate embodiment support pole and screen of the present invention.
Figure 16:
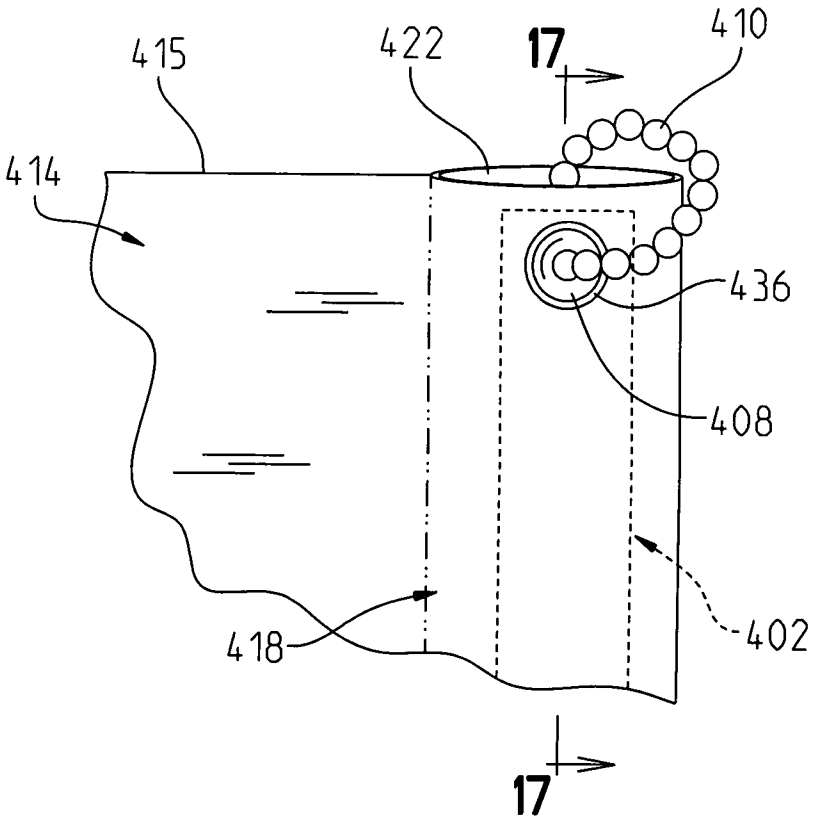
FIG. 16 is an enlarged assembled view of the alternate embodiment "sleeve-type" screen of the present invention.
Figure 17:
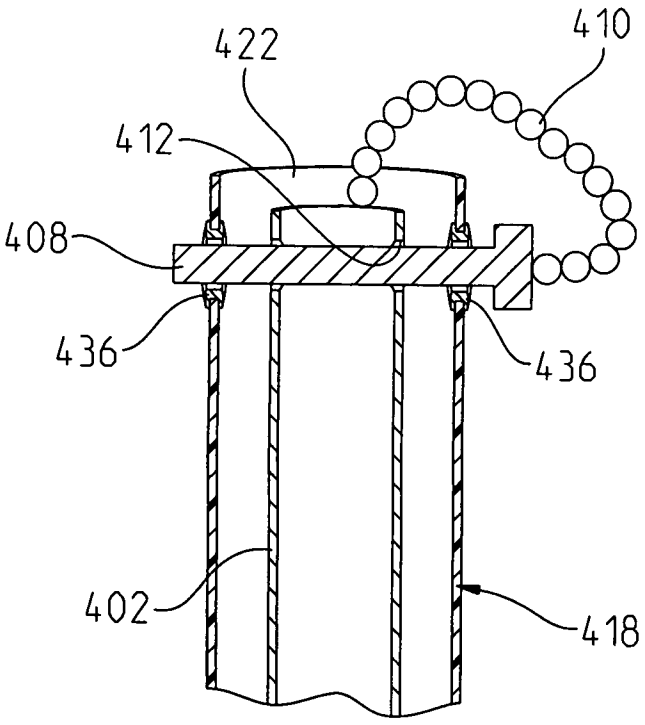
FIG. 17 is a sectional view taken along lines 17-17 of FIG. 16.

Turning now to FIGS. 15 and 18, the screen 414 is shown as including an operable flap 445. The flap 445 is held in the closed position (FIG. 15) through the use of a hook and eye (e.g. Velcro®) fastener 447 that is coupled to the fabric of the screen. The operable flap 445 is provided to enable the medical practitioner to open the flap to thereby better observe a patient who is lying on the bed, contained within the screen.

A nurse alert device that comprises a raiseable flag 452 is shown in FIGS. 20-23.

The nurse alert flag 452 is provided to enable a patient to signal the nurse that attention is needed. Additionally, the raiseable nurse alert flag 452 can be configured to display a message to medical personnel relating to the status of the patient.

Figure 20:
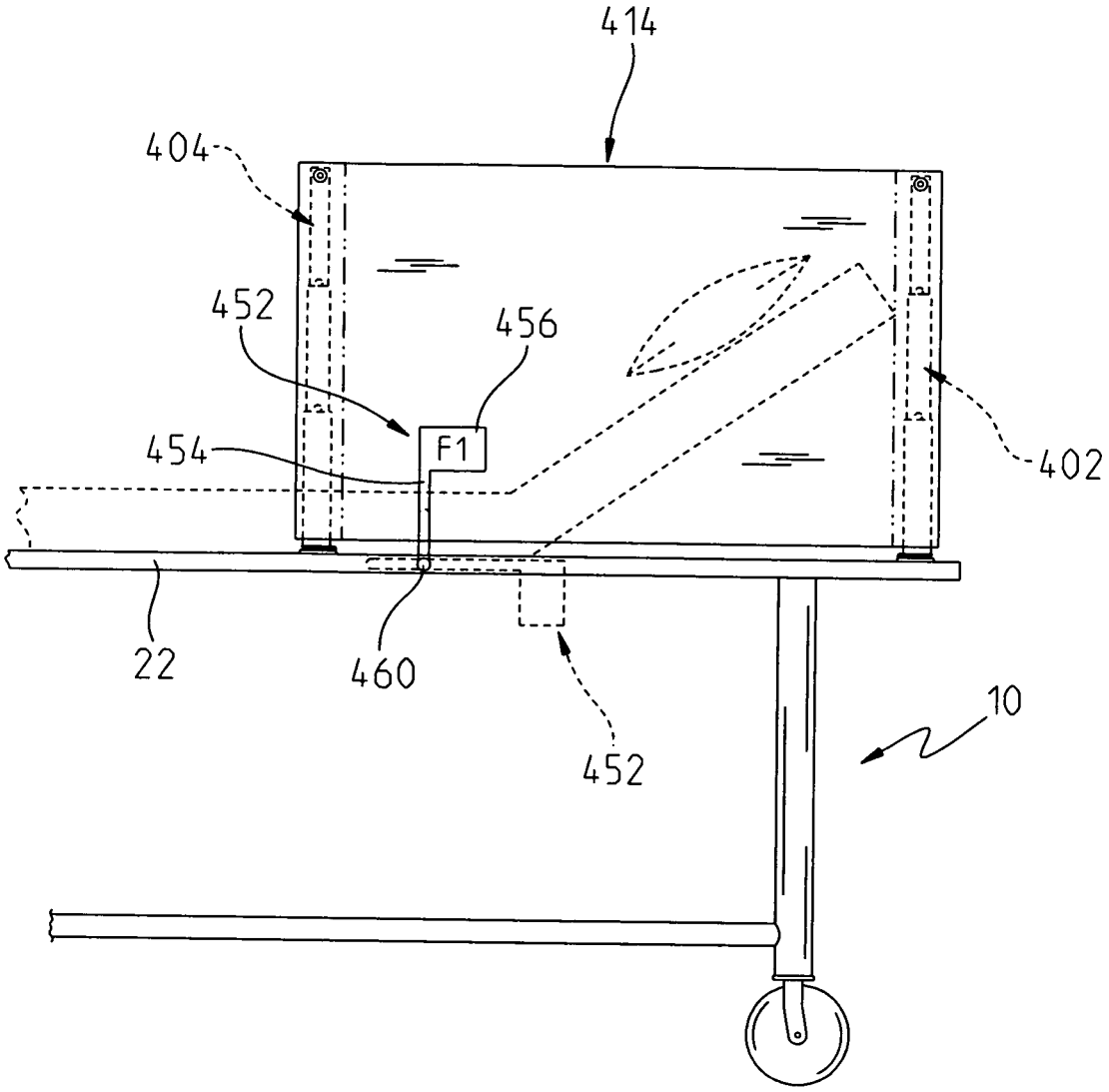
FIG. 20 is a side view of a gurney containing the alternate sleeve embodiment of the present invention showing an alternate embodiment nurse attention flag.

One of the interesting features of the particular nurse alert flag 452 shown in the drawings is that it is useable by the patient when the screen 414 is in the upright position as is shown in FIG. 20. Another interesting feature of the particular device is that it does not require any wires, electricity, batteries or other source of power. Rather, the device 452 operates somewhat similarly to a rural mailbox flag.

The raiseable flag 452 includes a staff portion 454 and a flag portion 456. The flag portion 456 can be a single color flag, or it can contain a message. Additionally, the device 452 can include a plurality of flags that are interchangeable with each other, to enable different messages to be displayed. A handle portion 458 is coupled to the staff portion 454 by an axle portion 460. Axle portion 450 is rotatably coupled to a side rail 22 of the gurney 10.

Figure 21:
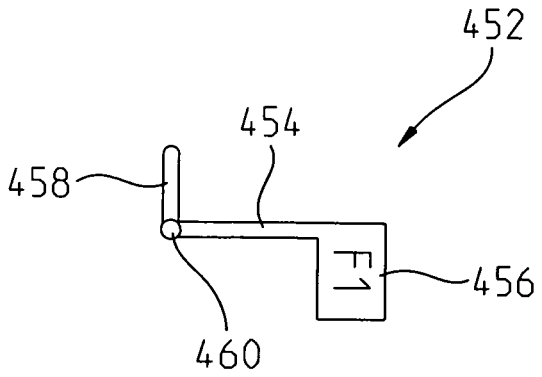
FIG. 21 is a side view of the alternate embodiment nurse attention flag of FIG. 20, shown in the lowered position.
Figure 22:
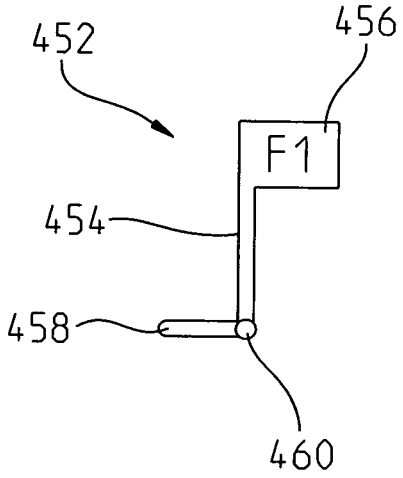
FIG. 22 is a side view of the alternate embodiment nurse attention flag of FIG. 21 showing the flag in the raised or alert position.
Figure 23:
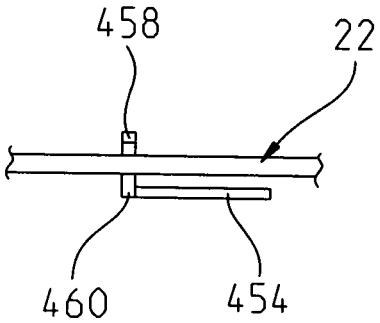
FIG. 23 is a top view of the alternate embodiment nurse attention flag of the present invention.

When the axle 460 extends through the side rail, the handle portion 458 is disposed interiorly within the interior of the enclosure formed by the screen 414, and the flag and staff portion 454, 456 are disposed exteriorly of the screen 414. It will also be noted that the handle portion 458 has an axis that is offset from the axis of the flag portion by preferably about 90°. As such, when the flag 456 and staff 454 portions are in their lower position as shown in FIG. 21, the handle 458 is raised to a generally vertical position. The user can then push the handle 458 down, by rotating the handle 458 and axle 460 to a position as shown in FIG. 22 wherein the handle portion 458 is generally parallel to the guide rail 422. This rotational movement of the handle 458 rotates axial 460 by approximately 90° that rotates staff 454 and hence flag 456 90°, to place the flag 456 in its upright or alert position, as shown in solid in FIG. 20.

Through this arrangement, a patient laying on a gurney inside the enclosure formed by the screen can alert his nurse to some need, by moving the handle 458 90°, to thereby move the flag 456 into the alert position. When in the alert position, it can be viewed by medical personnel, who will then know to attend to the user.

Alternately, the nurse or other practitioner who is exterior to the screen 414, can raise the flag by engaging the shaft portion 454, and rotating the flag about an axis 460 about a 90° arc. This movement by the nurse serves an important function if the nurse was just to use the flag to denote a signal to other practitioners. For example, one flag could denote that the user is ready for movement to a room; another flag could be used to denote that a particular user is ready for movement to an x-ray station, or more, while another flag could be used to denote that the patient is asleep, or is contagious, and thereby should be avoided.

Having described the invention in detail with reference to certain preferred embodiments, it will be appreciated that variations and modifications exist within the scope and spirit of the claims that are appended hereto.

What is claimed:

1. A moveable privacy screen configured for attachment to a bed having a mattress having a top surface, and at least four side surfaces, the privacy screen being extendable along at least three sides of the bed and being configured for restricting a view of a patient on the bed by persons passing by the bed, the privacy screen comprising a plurality of privacy screen segments attachable to the bed, the plurality of screen segments including at least first and second screen segments, each of the first and second screen segments including:

a first support pole having a variable length to permit the first support pole to move between a collapsed configuration and an expanded configuration;

a second support pole having a variable length to permit the second support pole to move between a collapsed configuration and an expanded configuration;

a coupler for movably coupling the first and second support poles to the bed in a spaced relation to permit the first and second support poles to move between an upstanding use position and a lowered storage position; and a non-transparent flexible sheet screen member coupled to each of the first and second support poles, and being sized to extend between the first and second support poles, the screen member being movable between a raised use position wherein first and second support pole and screen member extend above the mattress to thereby substantially prevent a patient on the mattress from being viewed by persons passing by the bed and a lowered storage position wherein the first and second support poles and screen member are disposed below the top surface of the mattress to thereby allow a patient on the mattress to be viewed by persons passing by the bed.

2. The privacy screen of claim 1 wherein the first and second support poles comprise first and second multi-segment telescoping support poles, the first and second support poles each including a selectively actuable gripper for permitting the poles to be fixedly positioned in the expanded configuration.

3. The privacy screen of claim 2 further comprising a first screen to pole fixed coupler for fixedly coupling the screen member to the first support pole, and a second screen to pole fixed coupler for fixedly coupling the screen member to the second support pole, wherein movement of the first and second telescoping support poles between the collapsed configuration and the expanded configuration causes the screen member to move between the lowered position and the raised position.

4. The privacy screen of claim 3 further comprising a plurality of first screen to pole moveable couplers for movably coupling the screen member to the first support pole and a plurality of second screen to pole movable coupling members for movably coupling the screen member to the first support pole, wherein the first and second support poles can move relative to the position of the first and second screen to pole movable coupler members.

5. The privacy screen of claim 4 wherein the plurality of first screen to pole movable couplers comprise a plurality of aperture-containing rings coupled to a first side edge of the screen member so that movement of the first support pole to screen movable couplers causes movement of the screen member, wherein the apertures of the ring are sized to slidably receive the first support pole.

6. The privacy screen of claim 5 wherein the plurality of second screen to pole movable couplers comprise a plurality of aperture-containing rings coupled to a second side edge of the screen member so that movement of the second support pole to screen coupler causes movement of the screen member, wherein the apertures of the ring are sized to slidably receive the second support pole.

7. The privacy screen of claim 3 wherein the screen member includes a first sleeve sized for slidably receiving the first support pole and a second sleeve sized for slidably receiving the second support pole.

8. The privacy screen of claim 7 wherein the screen member includes a top edge and a bottom edge, and the first sleeve includes an aperture disposed adjacent to the top edge, wherein the first screen to pole fixed coupler includes a portion extending through the aperture of the sleeve for selectively fixedly coupling the sleeve and screen member to the first support pole.

9. The privacy screen of claim 1 wherein the screen member is comprised of a washable fabric having a silver material incorporated therein in a sufficient amount to impart antimicrobial activity to the screen member.

10. The privacy screen of claim 1 wherein the bed includes a side frame member disposed adjacent, and extending along-side a side surface of a mattress of the bed, wherein each of the first and second support poles includes a proximal end and a distal end, and wherein the coupler hingedly couples the proximal end of the first and second support poles to the side frame member to permit the first and second support poles to move between the upstanding use position and the lowered storage position.

11. The privacy screen of claim 10 wherein the coupler for movably coupling the first and second support poles to the bed comprising a first coupler for movably coupling the first support pole to the bed, and a second coupler, independently operable from the first coupler, for movably coupling the second support pole to the bed.

12. The privacy screen of claim 10 wherein the coupler for movably coupling the first and second support poles to the bed permits the first and second support poles to move between the upstanding position where the first and second support poles are disposed generally perpendicular to the side frame member of the bed and the distal ends of the first and second support poles are positioned above the side frame member; and the lowered position wherein the first and second support poles are disposed generally perpendicular to the side frame member of the bed and the distal ends of the first and second support poles are positioned below the side frame member.

13. The privacy screen of claim 10 wherein the coupler for movably coupling the first and second support poles to the bed permits the first and second support poles to move between the upstanding position where the first and second support poles are disposed generally perpendicular to the side frame member; and the lowered position where the first and second support poles are disposed generally parallel to the side frame member.

14. The privacy screen of claim 1 wherein the flexible sheet screen member includes a flap portion movable between a closed and an opened position for facilitating observation of the patient.

15. The privacy screen of claim 1 further comprising an alert device coupled to the bed and movable between a non-alert configuration and an alert configuration, the alert device being placeable in the alert configuration for providing an indicia to a care giver relating to a condition of a patient on the bed.

16. The privacy screen of claim 15 wherein the alert device comprises a flag type alert including a handle portion disposed interiorly of the flexible sheet screen member, an alert flag disposed exteriorly of the flexible sheet screen member and a pivotable axle having a first end coupled to the handle portion and a second end coupled to the alert flag, wherein rotation of the pivotable axle permits the alert flag to move between the non-alert and the alert configuration.

17. The privacy screen of claim 1 wherein the screen member includes a top edge portion, bottom edge portion, a first side edge portion, and a second side edge portion; the bottom edge portion being movable to permit a medical practitioner to be positioned between the bed and the screen member to render treatment to the patient without the patient being viewed by persons passing the bed.

* * * * *